US008831457B2

(12) United States Patent
Yoshikawa et al.

(10) Patent No.: US 8,831,457 B2
(45) Date of Patent: Sep. 9, 2014

(54) FIXING DEVICE AND IMAGE FORMING APPARATUS

(71) Applicants: Hiroyuki Yoshikawa, Toyohashi (JP); Isao Watanabe, Toyohashi (JP); Harumitsu Fujimori, Machida (JP)

(72) Inventors: Hiroyuki Yoshikawa, Toyohashi (JP); Isao Watanabe, Toyohashi (JP); Harumitsu Fujimori, Machida (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 96 days.

(21) Appl. No.: 13/689,886

(22) Filed: Nov. 30, 2012

(65) Prior Publication Data

US 2013/0148995 A1 Jun. 13, 2013

(30) Foreign Application Priority Data

Dec. 12, 2011 (JP) ..... 2011-271672

(51) Int. Cl.
*G03G 15/20* (2006.01)

(52) U.S. Cl.
CPC ..... *G03G 15/2039* (2013.01); *G03G 15/2053* (2013.01); *G03G 2215/0132* (2013.01)
USPC ..... 399/69

(58) Field of Classification Search
CPC ..... G03G 21/20; G03G 2215/00084
See application file for complete search history.

(56) References Cited

U.S. PATENT DOCUMENTS

| | | | | |
|---|---|---|---|---|
| 7,620,338 | B2 | 11/2009 | Yamada et al. | |
| 2005/0173416 | A1 * | 8/2005 | Fukushi et al. | 219/619 |
| 2006/0216079 | A1 * | 9/2006 | Nanjo | 399/333 |
| 2011/0274446 | A1 * | 11/2011 | Fukushi | 399/22 |

FOREIGN PATENT DOCUMENTS

| | | | |
|---|---|---|---|
| JP | 2000-39796 | A | 2/2000 |
| JP | 2008-70757 | A | 3/2008 |
| JP | 2009-3264 | A | 1/2009 |
| JP | 2011-40323 | A | 2/2011 |

* cited by examiner

*Primary Examiner* — Claytone E Laballe
*Assistant Examiner* — Victor Verbitsky
(74) *Attorney, Agent, or Firm* — Buchanan Ingersoll & Rooney PC

(57) ABSTRACT

A fixing device includes an excitation coil, a fixing member heated by electromagnetic induction by the excitation coil, a magnetic shunt alloy member, a Curie temperature of which is higher than a target fixing temperature, a determiner that determines whether the temperature of a non-sheet passing region of the fixing member is about to reach the Curie temperature, and a power controller that controls power supplied to the excitation coil. Until the determiner determines that the Curie temperature is about to be reached, the power controller performs feedback control to provide power to the excitation coil. When the determiner determines that the Curie temperature is about to be reached, the power controller switches to fixed power control so that a difference between power supplied when the Curie temperature is about to be reached and power supplied after reaching the Curie temperature falls within an allowable range.

16 Claims, 25 Drawing Sheets

FIG. 6

Control frequency table

| | Column A | Column B |
|---|---|---|
| Control frequency (kHz) | When Curie temperature is about to be reached (W) | After reaching Curie temperature (W) |
| 44 | 670 | 658 |
| 45 | 650 | 625 |
| 46 | 630 | 593 |
| 47 | 610 | 560 |
| 48 | 590 | 528 |
| 49 | 570 | 495 |
| 50 | 550 | 463 |
| 51 | 530 | 430 |
| 52 | 510 | 398 |

FIG. 7

Fixed control frequency table

| Target power (W) | Fixed control frequency (kHz) |
|---|---|
| ⋮ | ⋮ |
| 610 | f1 |
| 590 | f2 |
| 570 | f3 |
| 550 | f4 |
| ⋮ | ⋮ |

Threshold control frequency table

| Target power (W) | Threshold control frequency (kHz) |
|---|---|
| 670 | 43.7 |
| 650 | 44.5 |
| 630 | 45.3 |
| 610 | 46.0 |
| 590 | 47.0 |
| 570 | 47.5 |
| 550 | 48.5 |
| 530 | 49.3 |
| 510 | 50.0 |

FIG. 17A Before Curie temperature is reached
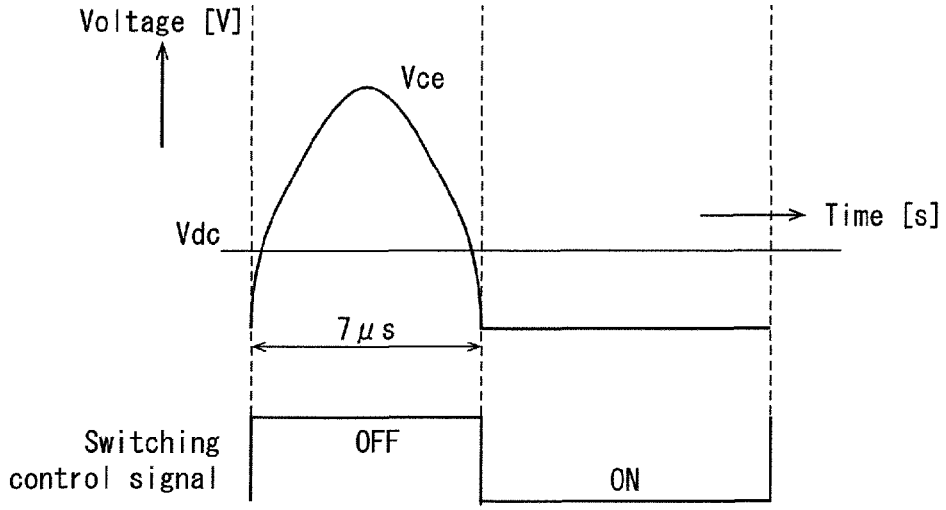
FIG. 17B After Curie temperature is reached
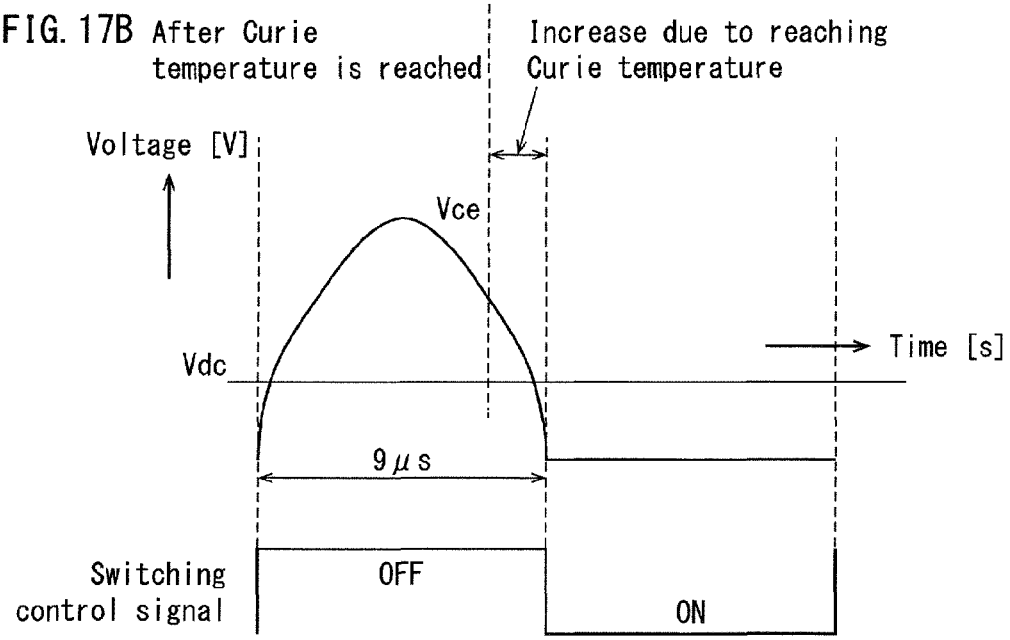

FIG. 18

Threshold resonance interval table

| Target power (W) | Threshold resonance interval (μs) |
|---|---|
| 670 | a1 |
| 650 | a2 |
| 630 | a3 |
| 610 | a4 |
| 590 | a5 |
| 570 | a6 |
| 550 | a7 |
| 530 | a8 |
| 510 | a9 |

FIG. 20

Basic threshold sheet number table

| Type of paper | A5T | B5T | A4T | B4T |
|---|---|---|---|---|
| Regular paper | 70 sheets | 83 sheets | 93 sheets | 110 sheets |
| Thick paper | 55 sheets | 66 sheets | 75 sheets | 90 sheets |

FIG. 21

Adjustment table H1 (adjustment based on environment)

| Type of paper | Environment | | | Adjustment sheet number | | | |
|---|---|---|---|---|---|---|---|
| | Label | Temperature | Humidity | A5T | B5T | A4T | B4T |
| Regular paper | LL | 10° C or less | 15% or less | 10 sheets | 11 sheets | 12 sheets | 14 sheets |
| | NN | 11-29° C | 16-79% | 0 sheets | 0 sheets | 0 sheets | 0 sheets |
| | HH | 30° C or greater | 80% or greater | -10 sheets | -11 sheets | -11 sheets | -12 sheets |
| Thick paper | LL | 15% or less | 15% or less | 10 sheets | 10 sheets | 10 sheets | 10 sheets |
| | NN | 11-29° C | 16-79% | 0 sheets | 0 sheets | 0 sheets | 0 sheets |
| | HH | 30° C or greater | 80% or greater | -10 sheets | -10 sheets | -10 sheets | -10 sheets |

FIG. 22

Adjustment table H2 (adjustment based on temperature at the start of warm-up)

| Temperature at the start of warm-up | Adjustment sheet number | | | | | | | |
|---|---|---|---|---|---|---|---|---|
| | Regular paper | | | | Thick paper | | | |
| | A5T | B5T | A4T | B4T | A5T | B5T | A4T | B4T |
| 15° C or less | 13 sheets | 19 sheets | 25 sheets | 29 sheets | 10 sheets | 15 sheets | 20 sheets | 23 sheets |
| 16-30° C | 0 sheets | 0 sheets | 0 sheets | 0 sheets | 0 sheets | 0 sheets | 0 sheets | 0 sheets |
| 31-50° C | -12 sheets | -14 sheets | -15 sheets | -20 sheets | -10 sheets | -12 sheets | -13 sheets | -15 sheets |
| 51-75° C | -24 sheets | -28 sheets | -30 sheets | -40 sheets | -20 sheets | -24 sheets | -26 sheets | -30 sheets |
| 76-100° C | -36 sheets | -42 sheets | -45 sheets | -60 sheets | -30 sheets | -36 sheets | -39 sheets | -45 sheets |
| 100-125° C | -48 sheets | -56 sheets | -60 sheets | -80 sheets | -40 sheets | -48 sheets | -52 sheets | -60 sheets |
| 126-150° C | -60 sheets | -70 sheets | -75 sheets | -100 sheets | -50 sheets | -60 sheets | -65 sheets | -75 sheets |
| 151° C or greater | -70 sheets | -83 sheets | -93 sheets | -110 sheets | -55 sheets | -66 sheets | -75 sheets | -90 sheets |

FIG. 23

Adjustment table H3 (adjustment based on standby interval)

| Standby interval | Adjustment sheet number | | | | | | | |
|---|---|---|---|---|---|---|---|---|
| | Regular paper | | | | Thick paper | | | |
| | A5T | B5T | A4T | B4T | A5T | B5T | A4T | B4T |
| Within 10 seconds | -70 sheets | -88 sheets | -95 sheets | -110 sheets | -55 sheets | -66 sheets | -75 sheets | -90 sheets |
| Less than one minute | -62 sheets | -77 sheets | -82 sheets | -94 sheets | -47 sheets | -55 sheets | -62 sheets | -74 sheets |
| 1-3 min | -54 sheets | -66 sheets | -69 sheets | -78 sheets | -39 sheets | -44 sheets | -49 sheets | -58 sheets |
| 3-5 min | -46 sheets | -55 sheets | -56 sheets | -62 sheets | -31 sheets | -33 sheets | -36 sheets | -42 sheets |
| 5-10 min | -38 sheets | -44 sheets | -43 sheets | -46 sheets | -23 sheets | -22 sheets | -23 sheets | -26 sheets |
| 10-15 min | -30 sheets | -33 sheets | -30 sheets | -30 sheets | -15 sheets | -11 sheets | -10 sheets | -10 sheets |
| 15-20 min | -22 sheets | -22 sheets | -17 sheets | -14 sheets | -7 sheets | -0 sheets | -0 sheets | -0 sheets |
| 20-25 min | -14 sheets | -11 sheets | -4 sheets | -0 sheets | -0 sheets | -0 sheets | -0 sheets | -0 sheets |
| 25-30 min | -6 sheets | -0 sheets | -0 sheets | -0 sheets | -0 sheets | -0 sheets | -0 sheets | -0 sheets |
| 31 minutes or more | -0 sheets | -0 sheets | -0 sheets | -0 sheets | -0 sheets | -0 sheets | -0 sheets | -0 sheets |

FIXING DEVICE AND IMAGE FORMING APPARATUS

This application is based on application No. 2011-271672 filed in Japan, the content of which is hereby incorporated by reference.

BACKGROUND OF THE INVENTION (1) Field of the Invention

The present invention relates to fixing devices and image forming apparatuses that are provided with a fixing member and that thermally fix an unfixed image onto a recording sheet, the fixing member being heated by electromagnetic induction and including a magnetic shunt alloy layer having a Curie temperature higher than a fixing temperature. More particularly, the present invention relates to technology for preventing the occurrence of uneven gloss and uneven fixing of a fixed image.

(2) Description of Related Art

An electromagnetic induction heating type fixing device is now commonly used as a fixing device in image forming apparatuses such as printers or copiers.

In such an electromagnetic induction heating type fixing device, high-frequency current is passed through an excitation coil to produce an alternating magnetic field, thus producing an eddy current in the heating layer of the fixing member, which is in the shape of a belt, resulting in Joule heating. This allows for a reduction in the heat capacity of the fixing member, thus offering advantages such as energy saving and a shorter time for warming up as compared to an image forming apparatus that has a fixing device using a heater.

The fixing member has a small heat capacity, however, making it easy for the temperature of the sheet passing region to lower due to the passing of a recording sheet. In order to maintain the temperature of the sheet passing region at the fixing temperature, it is necessary to continue heating the fixing member for the duration of heat fixing operations.

As a result, when many sheets pass continually through the nip, the temperature of non-sheet passing regions that are not deprived of heat by the recording sheets becomes extremely high. Such a high temperature causes the problem of deterioration of the fixing member, resulting in a shorter lifetime.

To address this problem, Japanese Patent Application Publication No. 2008-70757, for example, discloses a fixing device that heats a fixing member using a heat generating element that includes a magnetic shunt alloy. The magnetic shunt alloy has a Curie temperature set to be higher than the fixing temperature yet lower than the temperature limit of the fixing member.

The fixing device disclosed in this patent application publication uses a magnetic shunt alloy as the heat generating element. When the temperature of the heat generating element in the non-sheet passing regions rises to the Curie temperature, the heat generating element transitions from being ferromagnetic to being paramagnetic. The magnetic flux density flowing through this portion suddenly decreases, thus reducing the amount of heat. The temperature of the non-sheet passing regions of the fixing member is thus prevented from rising excessively.

The inventors discovered, however, that when using a magnetic shunt alloy in order to prevent an abnormal rise in temperature in the non-sheet passing regions, as in the fixing device of the above patent application publication, a reduction in fixity and a difference in glossiness in a portion of a recording sheet as compared to other portions occur when the recording sheet is passed just when the magnetic shunt alloy reaches the Curie temperature. Such uneven fixing and uneven gloss occur in a strip extending in the direction of width of the recording sheet (the direction orthogonal to the sheet passing direction).

Normally, temperature control of the fixing device is performed using feedback control in a power control unit, whereby the power supplied to the excitation coil is determined based on the surface temperature of the sheet passing region as detected by a temperature sensor, and the determined power is stably supplied to the excitation coil. When the magnetic shunt alloy in the non-sheet passing regions reaches the Curie temperature, as described above, the permeability suddenly changes, causing the inductance of the excitation coil to drastically change, which greatly lowers the output of the excitation coil.

The power control unit then performs feedback control in an attempt to recover the output of the excitation coil. Due to the resulting time lag, the temperature of a portion of the fixing member necessarily decreases, however, leading to an uneven temperature. This is thought to cause uneven fixing or uneven gloss along a strip in the recording sheet.

SUMMARY OF THE INVENTION

The present invention has been conceived in light of the above problems, and it is an object thereof to provide an electromagnetic induction heating type fixing device, and an image forming apparatus provided with the fixing device, that can suppress the occurrence of uneven fixing and uneven gloss while using a magnetic shunt alloy to prevent an excessive rise in temperature in the non-sheet passing regions of a fixing member.

In order to achieve the above object, a fixing device according to an aspect of the present invention is a fixing device comprising an excitation coil supplied with power and generating an alternating magnetic field; a fixing member heated by electromagnetic induction resulting from the alternating magnetic field; a pressing member forming a nip by pressing against the surface of the fixing member, an unfixed image on a recording sheet being thermally fixed to the recording sheet upon the recording sheet passing through the nip; a magnetic shunt alloy member having a Curie temperature set to be a predetermined temperature higher than a target fixing temperature and arranged so as to suppress, when heated to the Curie temperature and above, a rise in temperature in a non-sheet passing region of the fixing member, the non-sheet passing region being a region through which the recording sheet does not pass; a sheet passing region temperature detector configured to detect a temperature of a sheet passing region of the fixing member, the sheet passing region being a region through which the recording sheet passes; a determiner configured to determine whether a temperature of the non-sheet passing region is about to reach the Curie temperature; a power controller configured to set a parameter for controlling the power supplied to the excitation coil; and a power supply configured to supply the power to the excitation coil in accordance with the set parameter, wherein until the determiner determines that the temperature of the non-sheet passing region is about to reach the Curie temperature, the power controller performs first control to select a target power to be provided to the excitation coil, according to the temperature detected by the sheet passing region temperature detector, and to adjust the parameter so as to maintain the power supplied to the excitation coil at the target power by feedback control, and when the determiner determines that the temperature of the non-sheet passing region is about to reach the Curie temperature, the power controller switches to performing second control to provide power to the excitation coil by switching the parameter to a predetermined fixed parameter, the fixed parameter being set so that a difference between the power supplied when the temperature of the non-sheet passing region is about to reach the Curie temperature and the power supplied after reaching the Curie temperature falls within an allowable range.

Another aspect of the present invention is an image forming apparatus provided with the above fixing device.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings:

FIG. 6 shows an example of a control frequency table, showing the relationship between control frequency and target power, divided into two columns: when the Curie temperature is about to be reached (column A), and after reaching the Curie temperature (column B);

FIG. 7 shows an example of a fixed control frequency table showing the relationship between control frequency and target power;

FIGS. 17A and 17B show changes in the resonance waveform respectively before and after the Curie temperature is reached;

FIG. 18 shows an example of a threshold resonance interval table used in Modification 2 of the processing to determine whether the Curie temperature is about to be reached;

FIG. 20 shows an example of a basic threshold sheet number table used in Modification 3 of the processing to determine whether the Curie temperature is about to be reached;

FIG. 21 shows an example of an adjustment table for adjusting the number in the basic threshold sheet number table based on the environment within the apparatus;

FIG. 22 shows an example of an adjustment table for adjusting the number in the basic threshold sheet number table based on the temperature at the start of warm-up;

FIG. 23 shows an example of an adjustment table for adjusting the number in the basic threshold sheet number table based on a standby interval;

DESCRIPTION OF THE PREFERRED EMBODIMENTS

The following describes embodiments of an image forming apparatus according to the present invention adopted, by way of example, in a tandem-type color printer (hereinafter simply referred to as a "printer").

(1) Configuration of Printer

Figure 1:
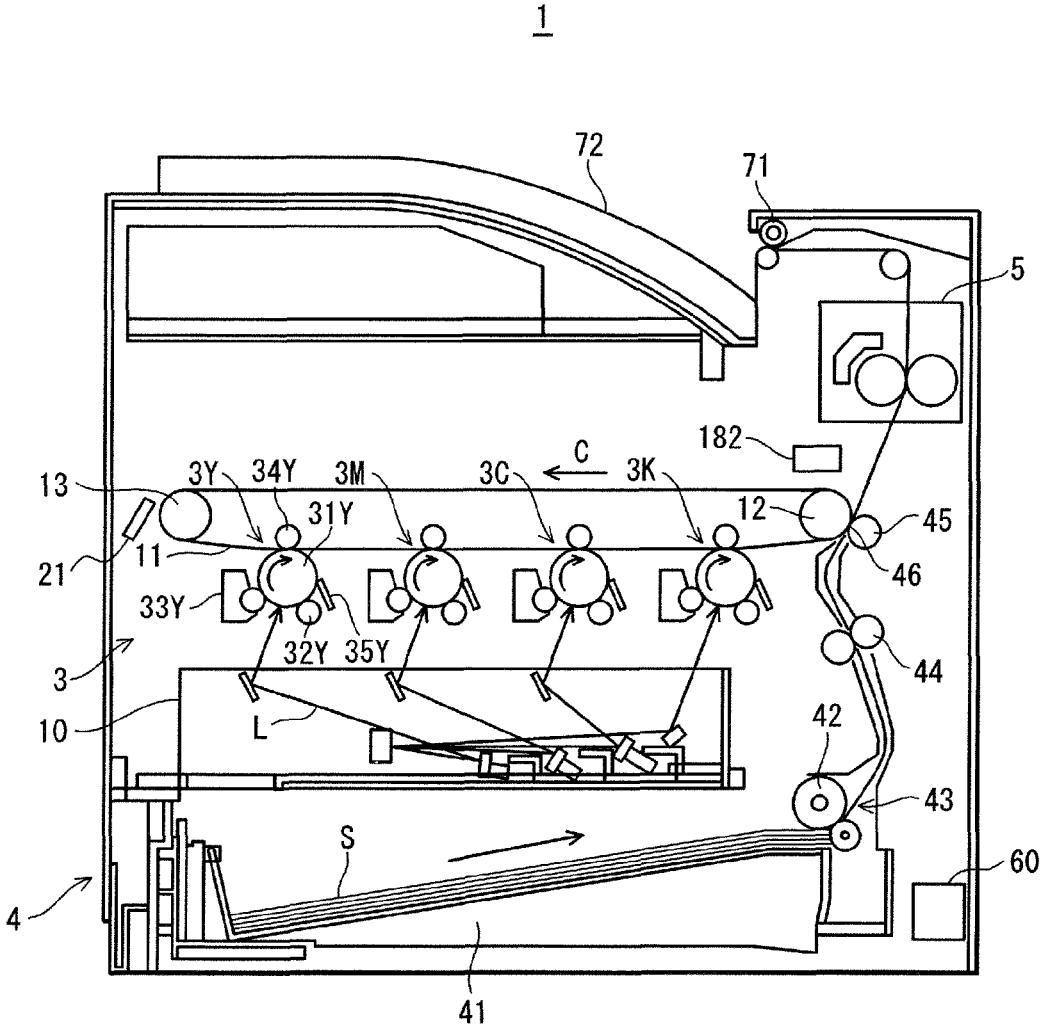
FIG. 1 illustrates the configuration of a printer having a fixing device according to an embodiment of the present invention.

FIG. 1 illustrates the structure of a printer 1 according to the present embodiment.

As illustrated in FIG. 1, the printer 1 is provided with an image process unit 3, a sheet feeder 4, a fixing device 5, a controller 60, and the like.

The printer 1 is connected to a network (for example, a LAN). Upon receiving a print instruction from an external terminal device (not shown in the figures) or an operation panel 7 (FIG. 4), the printer 1 performs a print process for a recording sheet by forming toner images of the colors yellow, magenta, cyan, and black in accordance with the print instruction and transferring the toner images in overlap onto the recording sheet in order to form a full-color image. Hereinafter, the reproduction colors yellow, magenta, cyan, and black are referred to as Y, M, C, and K, and the letters Y, M, C, and K are added as a suffix to the reference number of the respective constituent elements corresponding to these reproduction colors.

The image process unit 3 includes image creating units 3Y, 3M, 3C, and 3K, an exposure unit 10, an intermediate transfer belt 11, a secondary transfer roller 45, and the like. The image creating units 3Y, 3M, 3C, and 3K all have the same structure. The following explanation therefore focuses on the structure of the image creating unit 3Y.

The image creating unit 3Y is provided with a photoconductor drum 31Y and, disposed around the photoconductor drum 31Y, a charger 32Y, a developer 33Y a primary transfer roller 34Y, a cleaner 35Y for cleaning the photoconductor drum 31Y, and the like. The image creating unit 3Y forms a Y-color toner image on the photoconductor drum 31Y. The developer 33Y faces the photoconductor drum 31Y and transports charged toner to the photoconductor drum 31Y. The intermediate transfer belt 11 is an endless belt, stretched between a drive roller 12 and a passive roller 13, that rotates in the direction of the arrow C. Near the passive roller 13, a cleaner 21 is provided to remove toner remaining on the intermediate transfer belt.

The exposure unit 10 is provided with light emitting elements, such as a laser diode. In response to drive signals from the controller 60, the exposure unit 10 scans and exposes the photoconductor drum of the image creating unit 3Y by emitting laser light L for formation of the Y-color. Via this scanning and exposure, an electrostatic latent image forms on the photoconductor drum 31Y, which has been electrostatically charged by the charger 32Y. An electrostatic latent image is similarly formed on the photoconductor drum of each of the image creating units 3M, 3C, and 3K.

The electrostatic latent image formed on each photoconductor drum is developed by the respective developer of the image creating units 3Y, 3M, 3C, and 3K, thereby forming a toner image of the corresponding color on the respective photoconductor drum. The toner images thus formed consecutively undergo primary transfer via the respective primary transfer roller of the image creating units 3Y, 3M, 3C, and 3K (in FIG. 1, only the primary transfer roller corresponding to the image creating unit 3Y is labeled as 34Y, with labels being omitted for the other primary transfer rollers). The toner images are transferred to the intermediate transfer belt 11 at staggered times so as to overlap at the same position on the intermediate transfer belt 11, thus forming a color toner image.

The sheet feeder 4 is provided with a paper cassette 41, a pick-up roller 42, timing rollers 44, and the like. The paper cassette 41 stores recording sheets S. The pick-up roller 42 picks up one recording sheet at a time from the paper cassette 41 and feeds the recording sheet to a conveyance path 43. The timing rollers 44 convey the picked-up recording sheet to the secondary transfer position 46 at the proper timing.

Usage is not limited to one paper cassette; instead, a plurality may be used. Recording sheets of differing size and thickness (regular paper, thick paper, etc.) may be used. When a plurality of paper cassettes are adopted, recording sheets of differing size, thickness, or quality may be stored separately in the plurality of paper cassettes.

The timing rollers 44 convey recording sheets to a secondary transfer position 46 in alignment with the time at which the toner image formed in overlap by primary transfer at the same position on the intermediate transfer belt 11 is conveyed to the secondary transfer position 46. At the secondary transfer position 46, the secondary transfer roller 45 transfers the color toner images on the intermediate transfer belt 11 simultaneously onto the recording sheet by secondary transfer, thus forming a composite toner image on the recording sheet.

The recording sheet is then further conveyed to the fixing device 5. After the composite toner image (unfixed image) on the recording sheet is thermally fixed to the recording sheet by heat and pressure in the fixing device 5, the recording sheet is discharged into a discharge tray 72 by a discharge roller 71.

The operation panel 7 (see FIG. 4) is provided at the top of the front of the printer 1 at a position that is easy to operate. The operation panel 7 is provided with a plurality of input keys and a liquid crystal display. A touch panel is layered on the surface of the liquid crystal display. The operation panel 7 receives instructions from the user through key input that the user enters by touching either the touch panel or the input keys. The operation panel 7 then notifies the controller 60 of the key input.

The controller 60 performs unified control of the image process unit 3, the sheet feeder 4, and the like, in order to smoothly execute print operations.

(2) Structure of Fixing Device

Figure 2:
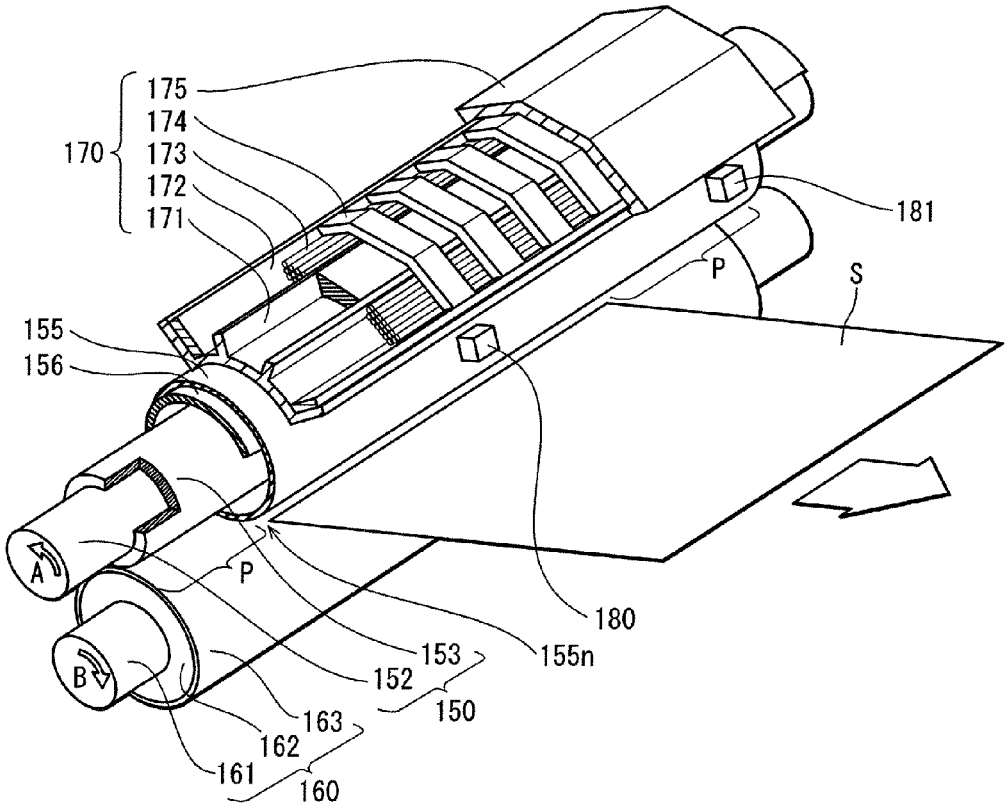
FIG. 2 is a perspective view showing a partial cross-section of the fixing device according to an embodiment of the present invention.
Figure 3A:
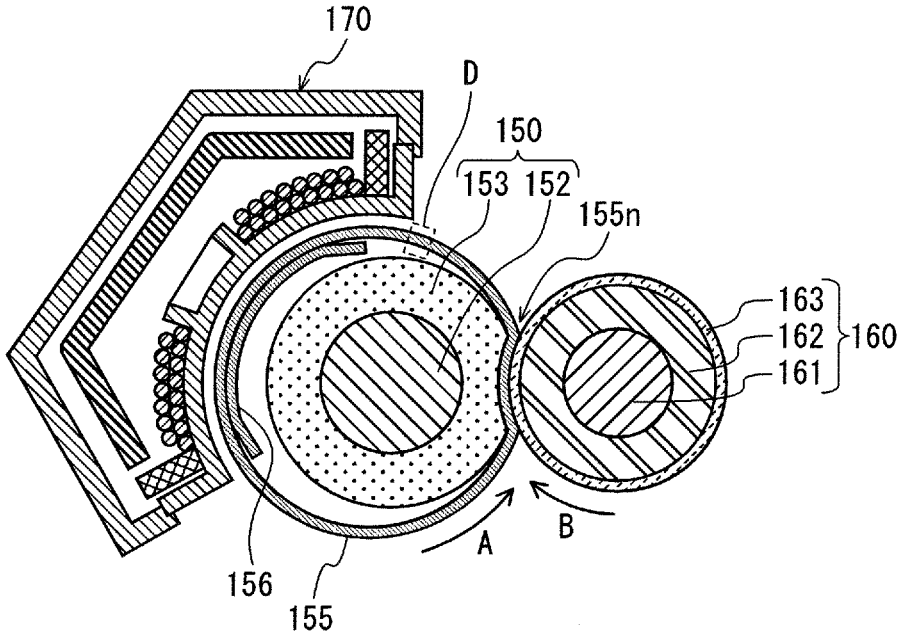
FIG. 3A and FIG. 3B are cross-section diagrams of the main sections of the fixing device.
Figure 3B:
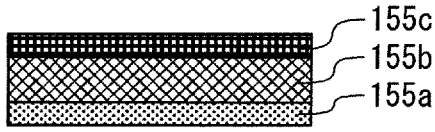

FIG. 2 is a partial perspective cross-sectional view illustrating the structure of the fixing device 5. FIGS. 3A and 3B are cross-section diagrams of the main structure of the fixing device 5. FIG. 3A is a horizontal cross-section diagram of the fixing device 5, whereas FIG. 3B is a partial cross-sectional diagram (of the section indicated by the dotted rectangle D in FIG. 3A) illustrating the detailed structure of a fixing belt 155.

As illustrated in FIG. 2, the fixing device 5 is an electromagnetic induction heating type fixing device and is provided with a fixing roller 150, the fixing belt 155, a guide plate 156, a pressing roller 160, a magnetic flux generator 170, a central thermistor 180, and an end thermistor 181.

The regions indicated by the letters P in FIG. 2 are non-sheet passing regions in the fixing belt 155. The recording sheet S does not pass through these regions.

The fixing roller 150 is constituted by an elongated, cylindrical metal core 152 covered by an elastic layer 153. As illustrated by the partial cross-sectional diagram in FIG. 3A, the fixing roller 150 is positioned on the inside of the running path of the fixing belt 155. The fixing roller 150 may, for example, have an outer diameter of 36 mm.

The metal core 152 is a member that supports the fixing roller 150. For example, the metal core 152 is a cylinder with an outer diameter of approximately 20 mm. The material constituting the metal core 152 may, for example, be aluminum, iron, stainless steel, or the like.

The elastic layer 153 prevents heat generated by the fixing belt 155 from escaping to the metal core 152. The elastic layer 153 also forms a fixing nip (155*n*) with the pressing roller 160 via the fixing belt 155, as illustrated in FIG. 3A. The thickness of the elastic layer 153 may, for example, be 8 mm. The material constituting the elastic layer 153 preferably has high heat resistance and thermal insulation properties. For example, an elastic foam of silicone rubber, fluorine-containing rubber, or the like may be used.

The fixing belt 155 is an endless belt, and as illustrated in FIG. 3B is formed by layering the following in this order: a magnetic shunt alloy layer 155*a*, an elastic layer 155*b*, and a releasing layer 155*c*. Note that a heating layer composed of nickel, copper, or the like may be provided between the magnetic shunt alloy layer 155*a* and the elastic layer 155*b*.

The magnetic shunt alloy layer 155*a* has the property of being ferromagnetic until reaching the Curie temperature and of becoming paramagnetic upon reaching the Curie temperature. Until reaching the Curie temperature, the magnetic shunt alloy layer 155*a* generates heat by electromagnetic induction, causing the temperature of the fixing belt 155 to rise. Upon reaching the Curie temperature, the magnetic shunt alloy layer 155*a* suppresses a rise in temperature of the fixing belt 155 due to electromagnetic induction.

The thickness of the magnetic shunt alloy layer 155*a* may, for example, be approximately 30 μm. The material constituting the magnetic shunt alloy layer 155*a* may, for example, be an alloy of nickel and iron. The Curie temperature of the magnetic shunt alloy layer 155*a* is set to a desired temperature by adjusting the blend ratio of nickel and iron. Alternatively, the material constituting the magnetic shunt alloy layer 155*a* may be an alloy of nickel, iron, and chrome.

It suffices for the Curie temperature to exceed the fixing temperature. If the difference between the Curie temperature and the fixing temperature is small, however, the rate of temperature increase of the fixing belt 155 will greatly drop by the time the temperature of the fixing belt 155 reaches the fixing temperature, thus causing the problem of an increase in the warm-up time before the start of heat fixing operations. It is therefore preferable that the Curie temperature be set at least 30° C. higher than the fixing temperature.

On the other hand, if the Curie temperature is set too far above the fixing temperature, the Curie temperature will exceed the temperature limit of the fixing belt 155, causing the fixing belt 155 to wear. It is therefore preferable that the Curie temperature at least be lower than the temperature limit of the fixing belt 155 (less than approximately 240° C.).

In the present embodiment, the Curie temperature of the magnetic shunt alloy layer 155*a* is set, for example, to 230° C., which is approximately 50° C. higher than the target control temperature of 180° C. during fixing.

The elastic layer 155*b* uniformly and flexibly transfers heat to the toner image on the recording sheet. Providing the elastic layer 155*b* prevents the toner image from being squashed or from fusing unevenly, thereby preventing the occurrence of image noise. The thickness of the elastic layer 155*b* may, for example, be approximately 200 μm. A rubber resin material that is heat resistant and elastic may be used as the material for the elastic layer 155*b*. For example, silicone rubber, fluorine-containing rubber, or the like may be used.

The releasing layer 155*c* forms the outermost layer of the fixing belt 155 and has the function of improving the releasability of the recording sheet from the fixing belt 155. The thickness of the releasing layer may be between 5 and 100 μm, and preferably within a range of 10 to 50 μm. A material that can withstand use at the fixing temperature and that has excellent releasability with respect to toner may be used as the material for the releasing layer 155*c*, For example, fluorine-containing resin such as perfluoroalkoxy (PFA), polytetrafluoroethylene (PTFE), fluorinated ethylene propylene (FEP), or fluorinated polyethylene propylene (PFEP) may be used.

The guide plate 156 is a plate for guiding the rotating fixing belt 155 in the direction of rotation. The guide plate 156 is provided on the inside of the running path of the fixing belt 155 at a position facing the magnetic flux generator 170 with the fixing belt 155 therebetween. The guide plate 156 is curved to conform to the curvature of the fixing belt 155 and is in contact with the inner surface of the rotating fixing belt 155, thereby guiding the fixing belt 155 in the direction of rotation and restricting the relative positions of the fixing belt 155 and the magnetic flux generator 170. A non-magnetic, low resistance material such as copper or aluminum, for example, may be used as the material for the guide plate 156.

Note that instead of forming the magnetic shunt alloy layer 155*a* in the fixing belt 155, the magnetic shunt alloy layer 155*a* may be provided in the guide plate 156 or the fixing roller 150. The fixing belt 155 may then be provided with a heating layer composed of copper, nickel, or the like instead of the magnetic shunt alloy layer 155*a*. When adopting the structure as well, as when providing the magnetic shunt alloy layer 155*a* in the fixing belt 155, the guide plate 156 or the fixing roller 150 may be heated by electromagnetic induction heating. The temperature of the fixing belt can then be caused to rise until the guide plate 156 or the fixing roller 150 reaches the Curie temperature, and a rise in temperature of the fixing belt can be suppressed when the guide plate 156 or the fixing roller 150 reaches the Curie temperature.

The pressing roller 160 is formed by a cylindrical metal core 161 surrounded by an elastic layer 162 on which is layered a releasing layer 163. The pressing roller 160 is positioned on the outside of the running path of the fixing belt 155. By pressing against the outside of the fixing belt 155, the pressing roller 160 presses against the fixing roller 150 with the fixing belt 155 therebetween, so as to form the fixing nip 155*n* between the pressing roller 160 and the outer surface of the fixing belt 155. The fixing nip 155*n* has a predetermined width in the direction of rotation.

The metal core 161 is a member that supports the pressing roller 160 and is formed from a strong, heat resistant material. The material for the metal core 161 may, for example, be aluminum, iron, stainless steel, or the like.

The elastic layer 162 is an elastic body with a thickness of between 1 and 20 mm. The elastic layer 162 is constituted by a highly heat resistant material such as silicone rubber, fluorine-containing rubber, or the like. The releasing layer 163 is a layer provided to improve the releasability of the recording sheet from the pressing roller 160 and may be formed from the same material and to the same thickness as the releasing layer 155*c*. The pressing roller 160 may, for example, have an outer diameter of approximately 35 mm.

The magnetic flux generator 170 includes a coil bobbin 171, sub-cores 172, an excitation coil 173, cores 174, and a cover 175. The magnetic flux generator 170 is provided on the outside of the running path of the fixing belt 155 opposite the pressing roller 160, with the fixing belt 155 therebetween, and extends in the direction of width of the fixing belt 155. The magnetic flux generator 170 is not positioned directly opposite the pressing roller 160, but rather is located slightly upstream in the direction of rotation of the fixing belt 155.

The excitation coil 173 generates magnetic flux for electromagnetic induction heating of the magnetic shunt alloy layer 155*a* in the fixing belt 155 and is wound around the coil bobbin 171. The alternating magnetic flux generated by the excitation coil 173 is guided to the fixing belt 155 by the cores 174 and the sub-cores 172, mainly passes through the portion of the magnetic shunt alloy layer 155*a* in the fixing belt 155 that faces the magnetic flux generator 170, and causes eddy current to occur in this portion. The eddy current causes the magnetic shunt alloy layer 155*a* itself to heat up, thus raising the temperature of the fixing belt 155.

Along with this rise in temperature of the fixing belt 155, the pressing roller 160 that is in contact with the fixing belt 155 at the fixing nip 155*n* also rises in temperature. The central thermistor 180 and the end thermistor 181 are respectively provided near the center and near an edge of the fixing belt 155 in the direction of width thereof in order to detect the surface temperature of the fixing belt 155. Note that is preferable for the end thermistor 181 to be provided at a position allowing for detection of the temperature of the non-sheet passing regions when the maximum size recording sheet is passed.

Based on detection signals from the central thermistor 180 and the end thermistor 181, the controller 60 controls the amount of power supplied to the excitation coil 173 via an 1 H power supply 190 (see FIG. 4) so that the surface temperature of the fixing belt 155 rises to a target temperature.

(3) Structure of Controller

Figure 4:
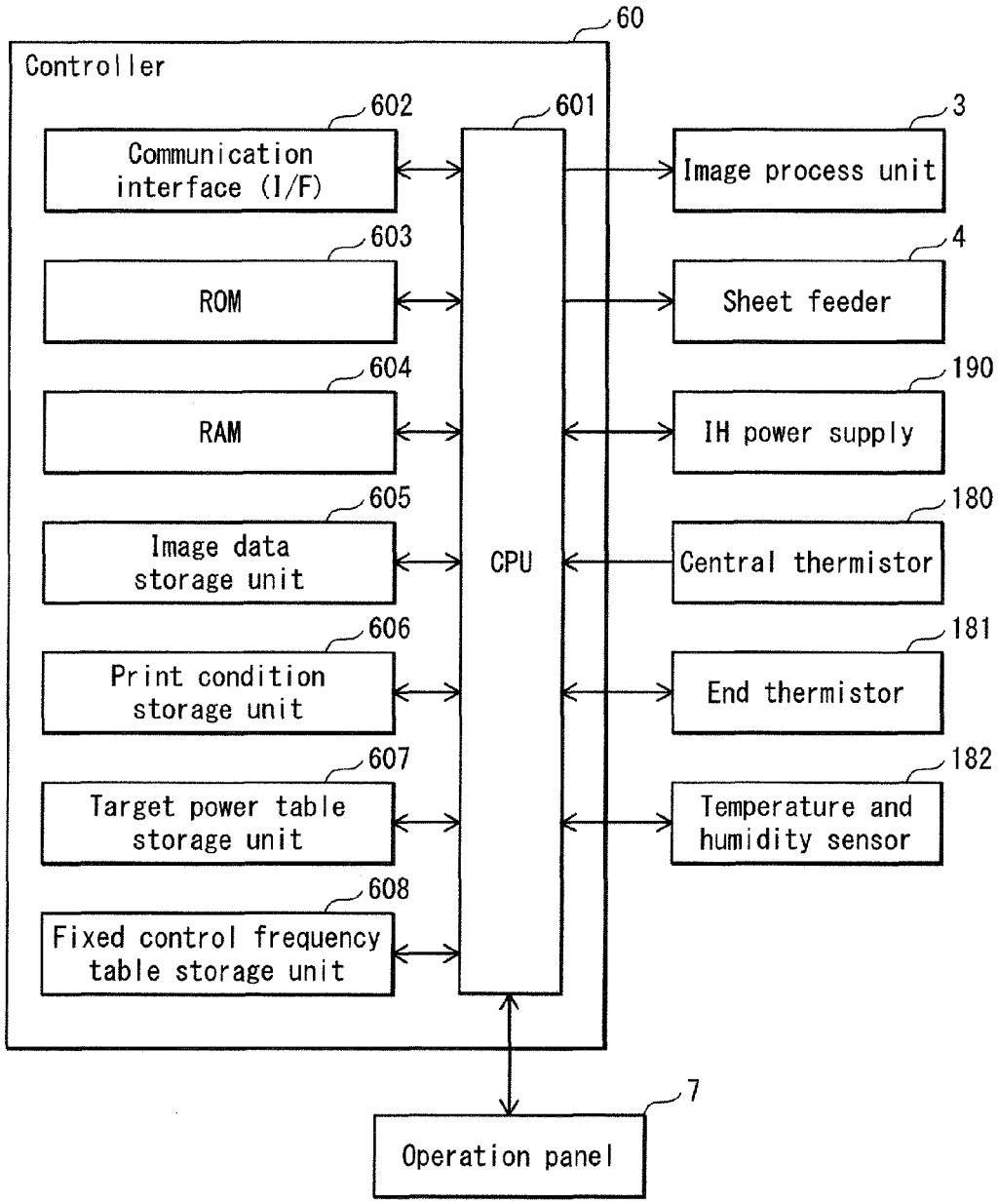
FIG. 4 shows the relationship between the structure of the controller and the main constituent elements that are controlled by the controller in the printer.

FIG. 4 shows the relationship between the structure of the controller 60 and the main constituent elements that are controlled by the controller 60. As shown in FIG. 4, the controller 60 is provided with a central processing unit (CPU) 601, a communication interface (I/F) 602, a read only memory (ROM) 603, a random access memory (RAM) 604, an image data storage unit 605, a print condition storage unit 606, a target power table storage unit 607, a fixed control frequency table storage unit 608, and the like.

The communication I/F 602 is an interface, such as a LAN card or LAN board, for connecting to a LAN.

The ROM 603 stores programs for controlling the image process unit 3, the sheet feeder 4, the IH power supply 190, the operation panel 7, and the like.

The RAM 604 is used as a work area during program execution by the CPU 601.

The image data storage unit 605 stores image data for printing. The image data is received via the communication I/F 602.

The print condition storage unit 606 extracts print conditions from print job data received from an external terminal and stores the extracted print conditions. In this context, "print conditions" include information designating the number of recording sheets to be printed, the size of the recording sheets, the type of recording sheet (regular paper, thick paper, etc.), and the like.

The target power table storage unit 607 stores a target power table. This table stores detected sheet passing region temperatures in association with the power to be supplied to the excitation coil 173 (target supplied power, hereinafter simply "target power") in order to make the temperature of the sheet passing region of the fixing belt 155 reach the target fixing temperature (the temperature that is the target of control during fixing).

The fixed control frequency table storage unit 608 stores a fixed control frequency table for determining the fixed control frequency when, as the non-sheet passing regions of the fixing belt 155 are about to reach the Curie temperature, control of power supplied to the excitation coil 173 switches from feedback control to control based on fixed control frequency. Details are provided below.

The IH power supply 190 includes an LC resonance circuit and supplies the target power as notified by the controller 60 to the excitation coil 173.

The controller 60 reads necessary programs from the ROM 603 and, based on image data stored in the image data storage unit 605, smoothly executes the print job by performing unified control of the image process unit 3, the sheet feeder 4, and the like in accordance with the print conditions. When executing the print job, the controller 60 controls the temperature of the fixing belt 155 by accurately controlling the IH power supply 190 based on the results of detection by the central thermistor 180 and the end thermistor 181.

Note that a temperature and humidity sensor 182 detects the temperature and humidity within the apparatus. Based on the detected values, the controller 60 performs a well-known image stabilization process by, for example, controlling the transfer voltages and the like and adjusting image density.

(4) Structure of IH Power Supply 190

Figure 5:
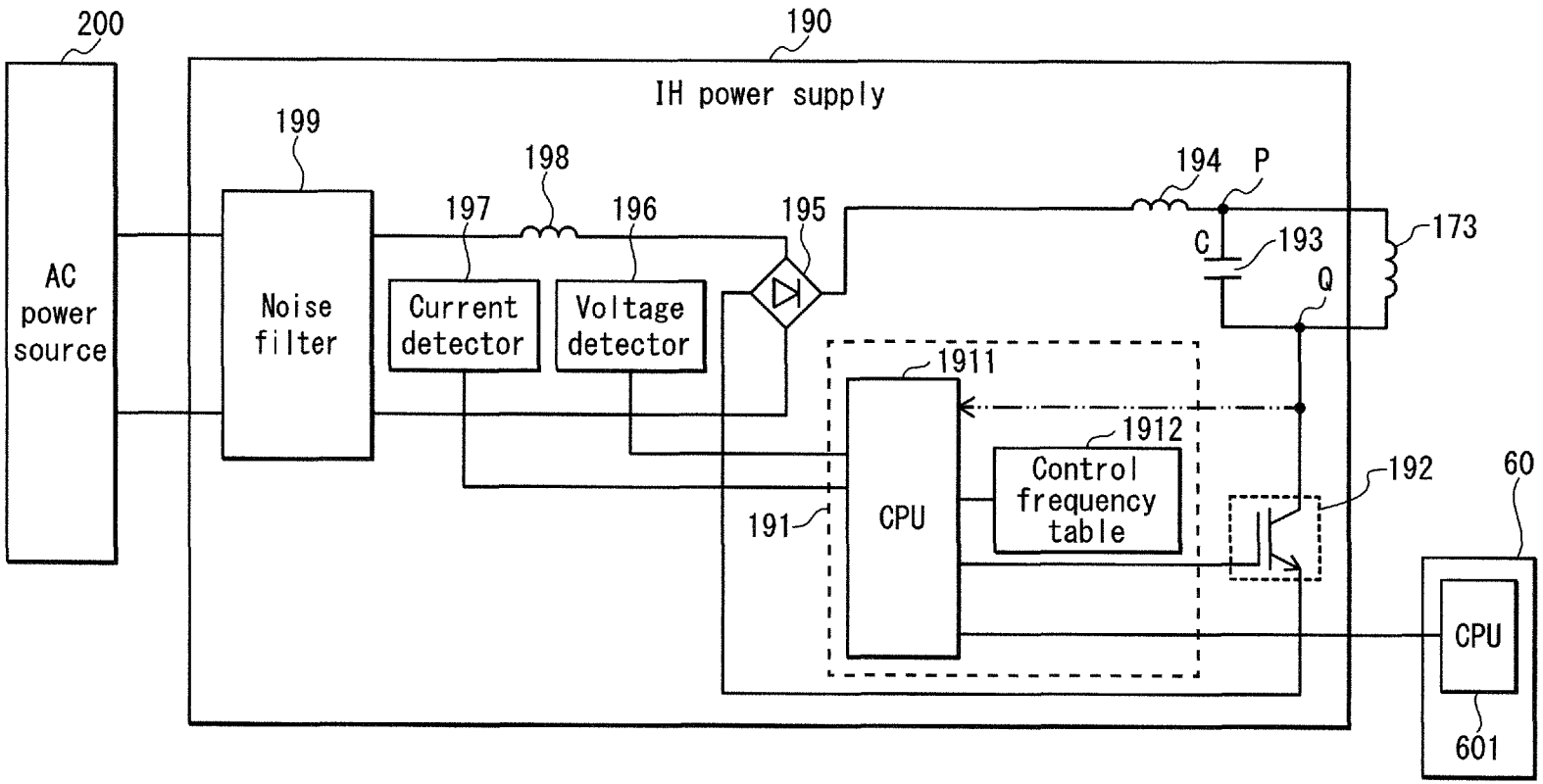
FIG. 5 is a circuit diagram showing an outline of an IH power supply.

FIG. 5 is a circuit diagram showing an outline of the IH power supply 190.

The IH power supply 190 shown in FIG. 5 includes a frequency controller 191, a switching element 192, a capacitor 193, a coil 194, a diode bridge 195, a voltage detector 196, a current detector 197, a coil 198, a noise filter 199, and the like.

The noise filter 199 removes a variety of noise components included in the power supplied by an AC power source 200. The diode bridge 195 rectifies the alternating current from the AC power source 200 after noise removal. The LC resonance circuit is composed of the capacitor 193 and the excitation coil 173. Via the coil 194, the positive voltage is applied to a connector P connecting the capacitor 193 and the excitation coil 173, whereas the negative voltage is applied to the emitter of a switching element 192 composed, for example, of an IGBT.

The collector of the switching element 192 is connected to another connector Q connecting the capacitor 193 and the excitation coil 173.

The frequency controller 191 is provided with a CPU 1911 and a control frequency table storage unit 1912.

FIG. 6 shows a specific example of a control frequency table stored in the control frequency table storage unit 1912.

As illustrated in FIG. 6, in order to control the power supplied from the IH power supply 190 to the excitation coil 173 so as to be the target power, the control frequency table shows the relationship between the target power and the control frequency, which is a control parameter for the switching element 192. The control frequency table lists two columns, one for before (column A) and one for after (column B) the surface temperature of the non-sheet passing regions P in the fixing belt 155 reaches the Curie temperature.

Note that this table shows an example for when a small-size recording sheet is selected (in the present embodiment, this is considered to be A4T sized regular paper, which refers to the size when A4 sized paper is conveyed in the direction of length thereof). The designer determines the values in this table in advance by experiment or the like. Unless otherwise noted, hereinafter, the values in the tables below are set assuming the use of A4T sized regular paper.

Furthermore, for the sake of convenience, the table in FIG. 6 only shows the target power values for representative control frequencies (44 kHz to 52 kHz) in a range necessary when regulating the temperature after the surface temperature of the sheet passing region in the fixing belt 155 reaches the target temperature for fixing (180° C.).

Based on the surface temperature of the sheet passing region in the fixing belt 155 detected by the central thermistor 180, the controller 60 refers to the target power table in the target power table storage unit 607 to determine the target power to be supplied to the excitation coil 173 in order for the surface temperature of the sheet passing region to reach the target fixing temperature. The controller 60 then notifies the frequency controller 191 in the IH power supply 190 of the target power thus determined.

The CPU 1911 of the frequency controller 191 receives the notification of the target power and refers to the control frequency table in the control frequency table storage unit 1912 to determine the control frequency at which to control the switching element 192. The CPU 1911 then controls the switching element 192 at the determined control frequency in order to provide the target power to the excitation coil 173. Note that the IH power supply 190 is structured so that as the control frequency decreases, the supplied power increases.

Normally, that is while the temperature of the non-sheet passing regions is not yet at a point at which the Curie temperature is about to be reached, if the CPU 1911 in the frequency controller 191 receives the notification of a target power of 550 W, for example, from the controller 60, then the CPU 1911 refers to column A of FIG. 6 to determine that the control frequency is 50 kHz, outputting this control frequency to the switching element 192.

Subsequently, the CPU 1911 calculates the power being supplied to the excitation coil 173 based on the results of detection, by the voltage detector 196 and the current detector 197, of the voltage and current actually supplied to the excitation coil 173. The CPU 1911 then performs feedback control to adjust the control frequency so that the supply of power to the excitation coil 173 is maintained at the target power notified by the controller 60.

After the temperature of the non-sheet passing regions reaches the Curie temperature, however, the output of the excitation coil 173 drops even if the control frequency remains the same.

This is because when the surface temperature of the non-sheet passing regions in the fixing belt 155 reaches the Curie temperature, the non-sheet passing regions become paramagnetic. As a result, magnetic flux produced by the excitation coil 173 is no longer guided to the non-sheet passing regions, and a corresponding portion of the magnetic flux produced by the excitation coil 173 returns to the excitation coil 173. The inductance of the excitation coil 173 therefore grows larger, causing a phase difference to occur between the voltage and the current supplied by the IH power supply 190 and leading to an increase in reactive power.

The CPU 1911 detects the drop in power through the output of the voltage detector 196 and the current detector 197 and lowers the control frequency so as to restore the power to the value before the drop. Since the drop in power is sudden, however, a non-negligible time lag occurs before feedback control can restore the power. During this time lag, a strip of the fixing belt 155 that was facing the excitation coil 173 reaches the nip with a lower temperature and comes into contact with the recording sheet, thus causing a portion of the recording sheet to have reduced fixity and glossiness as compared to other portions.

Figure 8:
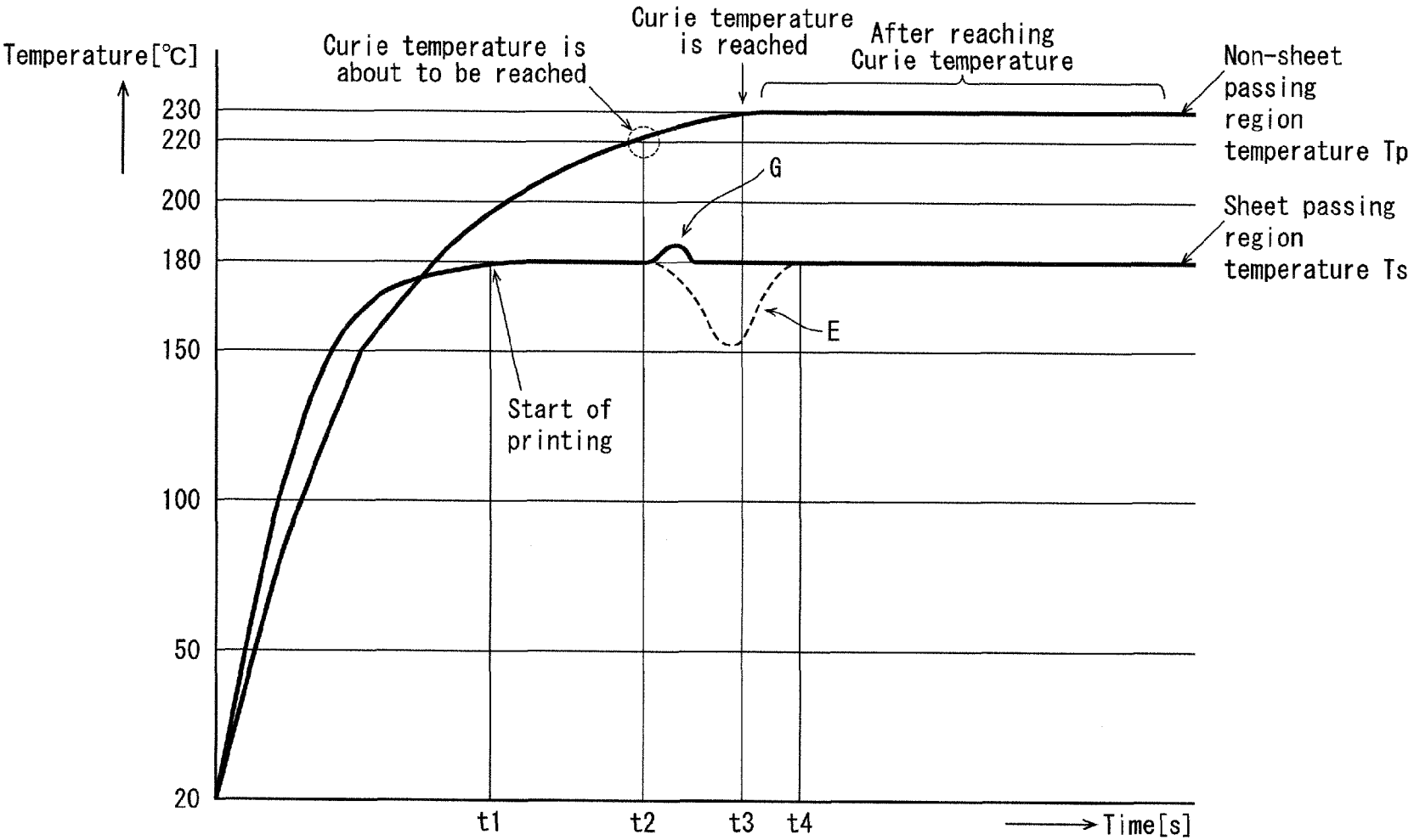
FIG. 8 is a graph showing changes in a sheet passing region temperature Ts and a non-sheet passing region temperature Tp of a fixing belt.

FIG. 8 is a graph showing approximate changes in the surface temperature of the sheet passing region (hereinafter "sheet passing region temperature Ts") and the surface temperature of the non-sheet passing regions (hereinafter "non-sheet passing region temperature Tp").

Note that in order to explain the occurrence of temperature variations in the sheet passing region, the curve indicating changes in the non-sheet passing region temperature Tp has been drawn to represent changes in temperature of the portion of the fixing belt 155 facing the excitation coil 173 when the Curie temperature is reached.

In FIG. 8, the vertical axis represents the temperature in degrees Celsius of the sheet passing region and the non-sheet passing regions, and the horizontal axis represents elapsed time in seconds from the start of warm-up control (control to raise the sheet passing region temperature of the fixing belt 155 to the target fixing temperature when the power is turned on or after exiting sleep mode).

As shown in FIG. 8, upon the sheet passing region temperature Ts reaching the target fixing temperature of 180° C. due to warm-up control, printing begins (time t1), and the difference in temperature between the non-sheet passing region temperature Tp and the sheet passing region temperature Ts expands. When the non-sheet passing region temperature Tp is about to reach the Curie temperature, the power supplied to the excitation coil 173 is gradually lowered, causing the sheet passing region temperature Ts to drop greatly by the time the Curie temperature is reached (time t3), as indicated by the dotted line E. When the supply of power is restored by feedback control, the sheet passing region temperature Ts rises back to the target fixing temperature of 180° C. (time t4).

With this conventional temperature control method, it is impossible to avoid a temporary drop in power when the non-sheet passing region temperature Tp reaches the Curie temperature.

To address this problem, the controller 60 in the present embodiment predicts when the non-sheet passing region temperature Tp will reach the Curie temperature and, immediately before this time, suspends feedback control of the supplied power in the IH power supply 190. The controller then forces the control frequency that is output to the switching element 192 to change to a fixed control frequency set in advance in anticipation of the above drop in power (hereinafter, this control is referred to as "fixed frequency control").

This fixed control frequency is determined in advance as a control frequency that allows for the target power notified by the controller 60 to be maintained even if reactive power of the excitation coil 173 increases upon the non-sheet passing regions P of the fixing belt 155 reaching the Curie temperature. The fixed control frequency is stored in the fixed control frequency table storage unit 608.

FIG. 7 shows an example of the above fixed control frequency table.

As shown in FIG. 7, the fixed control frequency table stores target powers notified by the controller 60 and corresponding fixed control frequencies. Note that the specific values for the fixed control frequencies can be sought based on the correspondence relationship between the target power after reaching the Curie temperature (column B) and the control frequency in the control frequency table in FIG. 6.

For example, in order to maintain a target power notified by the controller 60 of 550 W after the Curie temperature is reached, a control frequency of 47.3 kHz is necessary based on the correspondence relationship between the control frequency on the left side and the power in column B. This value is set as the fixed control frequency f4 (in the present embodiment, the control frequency corresponding to a power of 550 W is prorated based on the control frequency of 48 kHz corresponding to the value of 528 W and the control frequency of 47 kHz corresponding to the value of 560 W in column B).

When the target power is 550 W, the fixed control frequency when switching to fixed frequency control is 47.3 kHz. If this change is performed through feedback control, a significant time lag occurs. In the present embodiment, on the other hand, the target control frequency can be switched to without delay. Furthermore, the switch is made when the Curie temperature is about to be reached, thereby effectively suppressing a drop in the power supplied to the excitation coil 173 upon reaching the Curie temperature.

In fact, the power that is supplied during fixed frequency control when the Curie temperature is reached need not perfectly match the target power. It poses no problem for this power to differ slightly from the target power as long as the occurrence of uneven gloss is hardly noticeable. The allowable range of the temperature difference is approximately ±5° C.

Note that in the present embodiment, it is determined that Curie temperature is about to be reached when a temperature of 220° C. is reached (time T2), which is 10° C. lower than the Curie temperature.

Figure 9:
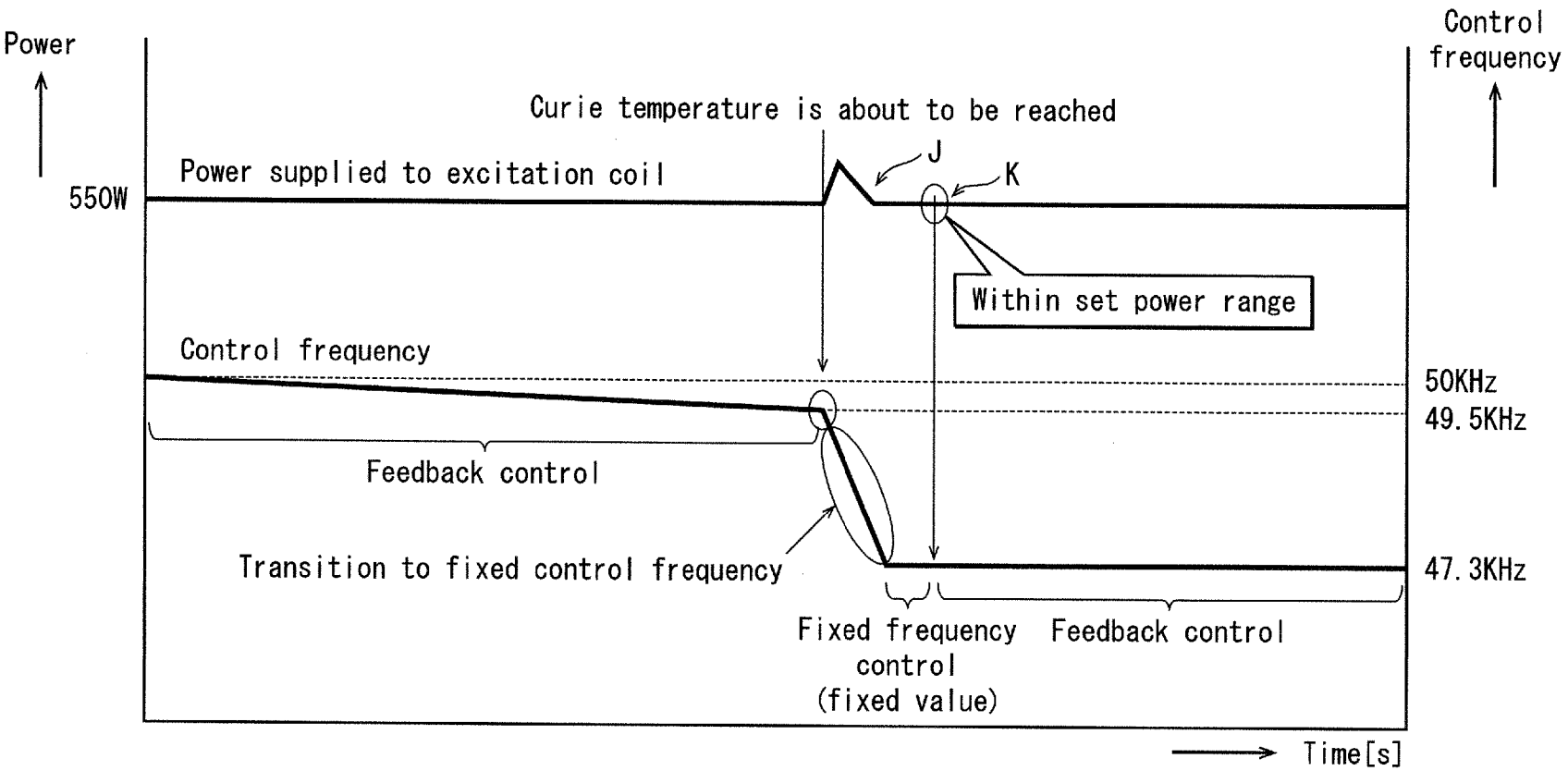
FIG. 9 is a graph showing changes in the power supplied to an excitation coil and changes in the control frequency in the IH power supply for controlling a switching element when performing temperature regulation according to an embodiment of the present invention.

FIG. 9 is a graph outlining changes in the power supplied to the excitation coil 173 and the control frequency when performing the above fixed frequency control.

Upon being notified by the controller 60 of the target power for the excitation coil 173, such as 550 W, the frequency controller 191 reads the control frequency corresponding to 550 W from column A of FIG. 6 (50 kHz) and controls the switching element 192 at this control frequency.

The frequency controller 191 detects the power actually being supplied to the excitation coil 173 based on the output of the voltage detector 196 and the current detector 197 and performs feedback control to adjust the control frequency so that the detected power value becomes equivalent to the target power.

When many sheets pass continually through the nip, the non-sheet passing region temperature Tp rises gradually, and when nearing the Curie temperature, the output of the excitation coil 173 drops. In an early stage, however, the above feedback control provides an adequate response, gradually lowering the control frequency so that the power supplied to the excitation coil 173 becomes 550 W.

When the non-sheet passing region temperature Tp reaches 220° C., it is determined that the Curie temperature is about to be reached. The frequency controller 191 then suspends feedback control and performs fixed frequency control by switching to a frequency of 47.3 kHz, which corresponds to the target power of 550 W, as determined by referring to the fixed control frequency table in FIG. 7.

When switching to this fixed frequency control (the time required for frequency transition hereinafter being referred to as the "fixed frequency transition time"), a portion (J) in which the output of the excitation coil 173 slightly exceeds the target power of 550 W occurs. However, as this is a slight increase in power, it does not lead to the occurrence of uneven fixing or uneven gloss.

Since the goal of fixed frequency control is to prevent a drop in power when the Curie temperature is reached, it is preferable to have completed the transition to the fixed control frequency (in the above example, 47.3 kHz) when reaching the Curie temperature. Accordingly, it can be considered preferable to determine that the point at which the "Curie temperature is about to be reached" is a point in time that precedes the time at which the Curie temperature is actually reached by a length of time equal to the fixed frequency transition time.

The rate of temperature increase of the non-sheet passing region temperature Tp just before the Curie temperature is reached may be sought by experiment or by simulation. This allows for calculation of the non-sheet passing region temperature Tp at a point in time preceding the arrival at the Curie temperature of 230° C. by exactly the fixed frequency transition time (in the present embodiment, this temperature is 220° C.). Upon reaching this temperature (i.e. the temperature indicating that the Curie temperature is about the reached), it can then be determined that the Curie temperature is in fact about to be reached.

As long as the transition to the control frequency by fixed frequency control starts before the time that the Curie temperature is reached, the effect of suppressing a reduction in power is still achieved as compared to control that depends only on conventional feedback control, even if the transition to the fixed control frequency is completed after the Curie temperature is reached. Such a transition may therefore still be considered to be take place when "the Curie temperature is about to be reached", and error within this range is tolerable. A transition to the fixed control frequency that is complete somewhat before the Curie temperature is reached is also tolerable, as long as the increase in temperature does not cause uneven fixing or uneven gloss.

Note that the fixed frequency transition time may be determined in advanced based on factors such as the processing speed of the CPU 1911 and the difference between the fixed control frequency and the control frequency before switching to fixed frequency control.

Strictly speaking, the difference between the fixed control frequency and the control frequency before switching to fixed frequency control differs to some degree depending on the target power. Furthermore, the rate of increase of the non-sheet passing region temperature Tp varies slightly depending on the size and thickness of the recording sheet being passed. It can therefore be assumed that the threshold temperature for determining whether the Curie temperature is about to be reached will vary somewhat. This threshold temperature may be determined uniformly, however, regardless of the sources of errors as long as the uneven fixing or uneven gloss is within the above allowable range.

If more accurate control is necessary, such as when reproducing precision color images, categorization may be performed by at least one of the target power, the size of the recording sheet, and the thickness of the recording sheet, and different threshold temperatures may be set for each category (for example, when categorizing by recording sheet size, a table may be created listing the threshold temperatures for each size).

Such fixed frequency control is only temporary control for avoiding a large fluctuation in power when reaching the Curie temperature, and is preferable to perform feedback control quickly thereafter.

Since the control frequency is switched to suddenly, power may be slightly unstable after the Curie temperature is reached. Therefore, immediately returning to feedback control may affect subsequent temperature control. To address this problem, it is determined in the present embodiment whether the power after reaching the Curie temperature is within a predetermined set power range with respect to the target power that was set when the Curie temperature was about to be reached. Feedback control is returned to only when the power is within the set power range (position K in FIG. 9).

In the present embodiment, this power range is set to be ±2% of the target power.

Note that during this fixed frequency control, the waiting time for the power to stabilize within the set power range may be sought by experiment or the like. Therefore, after switching to the fixed frequency control, feedback control may be returned to once this waiting time has elapsed, instead of determining whether the power is within the set power range.

(5) Temperature Regulation

Figure 10:
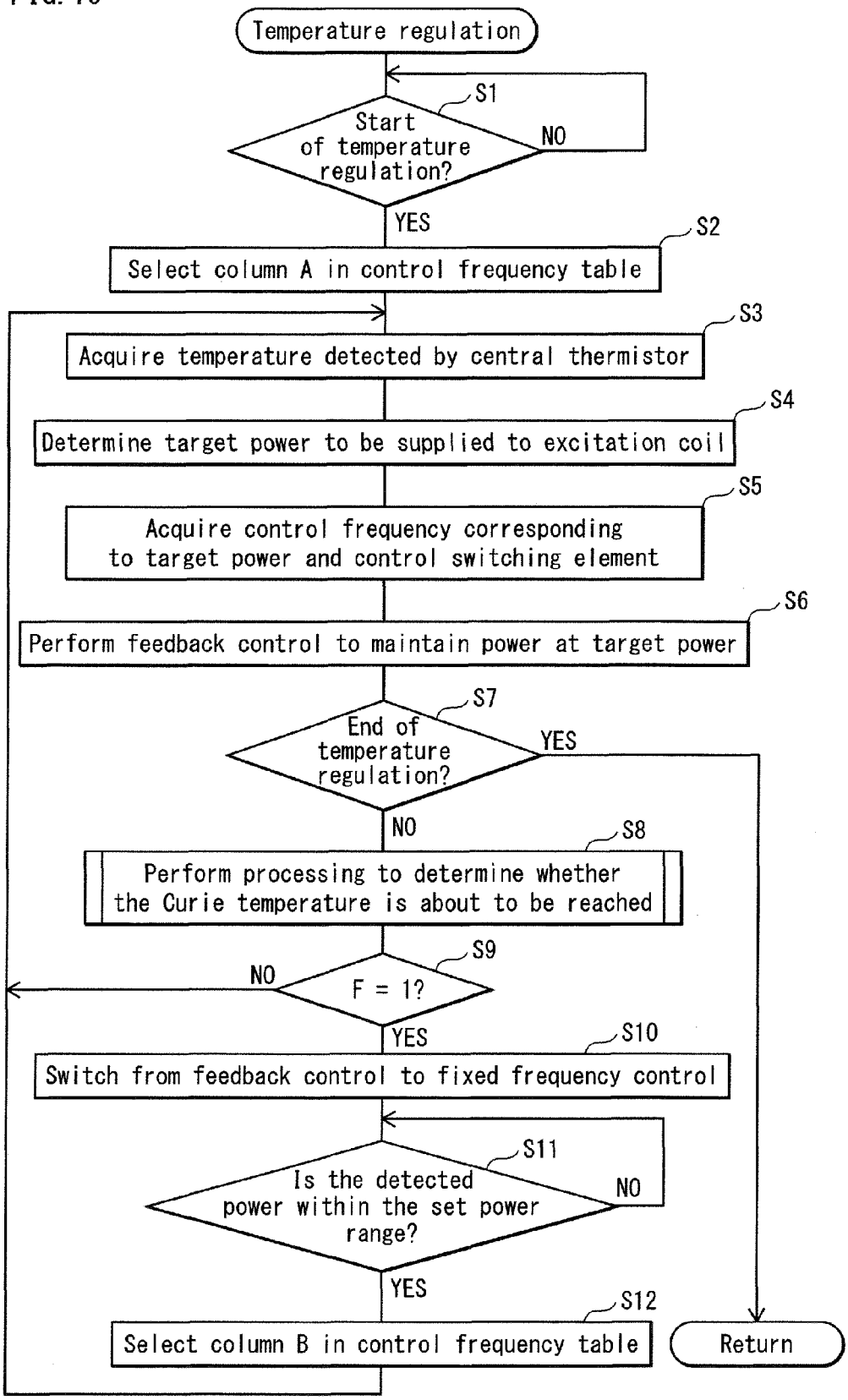
FIG. 10 is a flowchart showing control during the temperature regulation according to an embodiment of the present invention.

FIG. 10 is a flowchart showing control for temperature regulation in the present embodiment in order to maintain the fixing belt 155 at the fixing temperature when performing a print job after, for example, warm-up. This temperature regulation is performed by the controller 60 and by the frequency controller 191 in the IH power supply 190.

The processing in this flowchart is performed as a subroutine of the main flowchart (not shown in the figures) for controlling the overall operations of the printer 1.

First, in step S1, it is determined whether temperature regulation is to begin.

It is determined that temperature regulation is to begin after performing control for the temperature of the fixing belt 155 to rise to the target fixing temperature (180° C.) in cases such as the following: after power is turned on to the printer 1, after exiting from sleep mode (a mode that suspends the supply of power to the excitation coil 173 in order to conserve power) upon receiving a print job, or after exiting standby mode (a mode in which the fixing belt 155 is maintained at a temperature slightly lower than the target fixing temperature in order to allow for a print job to be commenced rapidly when received).

At the initial stage of a print job, the non-sheet passing region temperature Tp in the fixing belt 155 is still much lower than the Curie temperature. Therefore, column A is selected from the control frequency table in FIG. 6 (step S2).

The temperature detected by the central thermistor 180 is acquired (step S3) and compared to the target fixing temperature. Based on the results of comparison, the table in the target power table storage unit 607 is referred to in order to determine the target power to be provided to the excitation coil 173 in order to maintain the temperature at the target fixing temperature (step S4).

The CPU 1911 in the frequency controller 191 of the IH power supply 190 is notified of the determined target power and then acquires the control frequency corresponding to the target power by referring to the currently selected control frequency table. The CPU 1911 then controls the switching element 192 by outputting this selected control frequency (step S5).

The CPU 1911 performs feedback control by monitoring the power that is applied to the excitation coil 173 and adjusting the control frequency so that the power is maintained at the above target power (step S6). The CPU 1911 monitors the power by sampling of the values detected by the voltage detector 196 and the current detector 197.

Next, it is determined whether temperature regulation is to be terminated (step S7).

For example, when a print job in progress is complete, or when a predetermined time has elapsed after completion of the print job, it is determined that temperature regulation is to be terminated.

When not terminating temperature regulation (step S7: NO), processing for determining whether the Curie temperature is about to be reached is performed (step S8).

Figure 11:
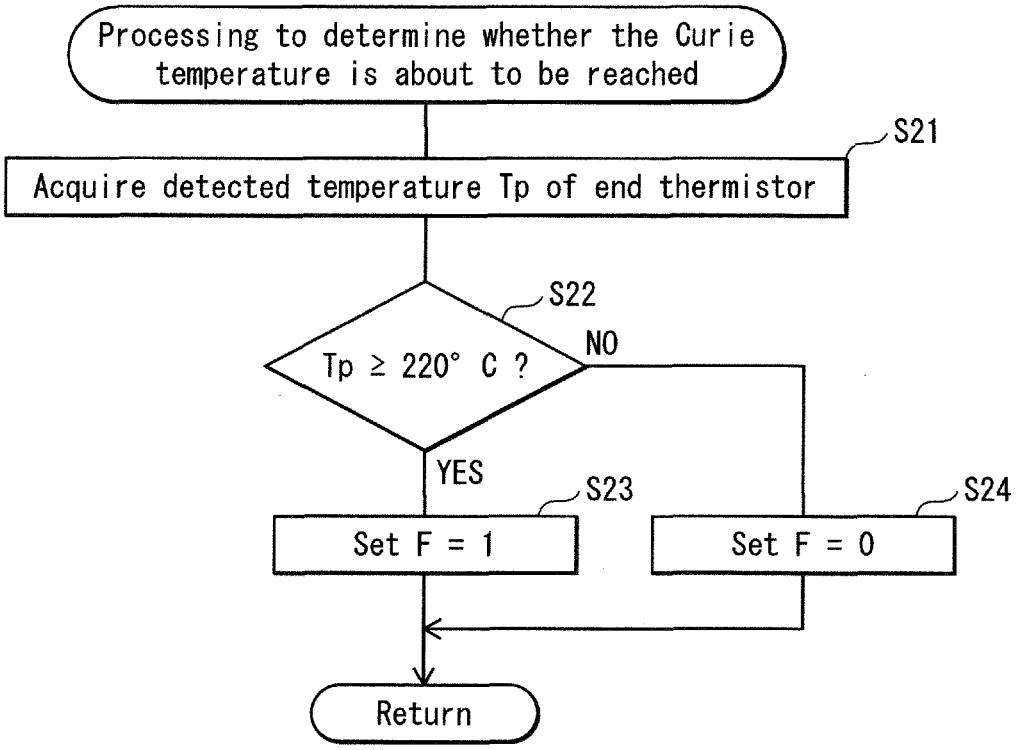
FIG. 11 is a flowchart showing control for processing to determine whether the Curie temperature is about to be reached in step S8 of the flowchart in FIG. 10.

FIG. 11 is a flowchart showing the control in a subroutine for the processing to determine whether the Curie temperature is about to be reached.

First, the non-sheet passing region temperature Tp detected by the end thermistor 181 is acquired (step S21). It is then determined whether the non-sheet passing region temperature Tp has reached a threshold temperature (in the present embodiment, 220° C.), predetermined as described above, i.e. whether Tp≥220° C. (step S22).

If Tp≥220° C. (step S22: YES), it is determined that the Curie temperature is about to be reached, and a flag F1 is set to 1 (step S23). On the other hand, if Tp≤220° C. (step S22: NO), the flag F1 is cleared to 0 (step S24).

Subsequently, processing returns to the flowchart in FIG. 10.

In step S9 of FIG. 10, it is determined whether F=1. If not (step S9: NO), the Curie temperature is not about to be reached. Processing therefore returns to step S3, and the feedback control until step S6 is repeated.

In step S9, if F=1 (step S9: YES), it is determined that the Curie temperature is about to be reached. The controller 60 acquires the fixed control frequency, corresponding to the target power of which the CPU 1911 has currently been notified, from the fixed frequency table (FIG. 7) in the fixed control frequency table storage unit 608. The controller 60 then instructs the CPU 1911 to switch the control frequency to this fixed control frequency. The CPU 1911 suspends feedback control in accordance with this instruction and controls the switching element 192 at the fixed control frequency indicated by the instruction (step S10).

Subsequently, the power being supplied to the excitation coil 173 is detected based on the values detected by the voltage detector 196 and the current detector 197, and it is determined whether the detected power is within the set power range (step S11).

When it is determined in step S11 that the detected power is within the set power range (step S11: YES), column B in the control frequency table in FIG. 6 is selected in order to return to feedback control (step S12).

Subsequently, processing returns to step S3, and feedback control of the power supplied to the excitation coil 173 is performed while referring to column B in the selected control frequency table.

The flowchart is cycled through again, and temperature regulation is terminated upon determining affirmatively in step S7. Processing then returns to the main flowchart not shown in the figures.

Instead of determining whether the detected power is within the set power range in step S11 as described above, the time that has elapsed since switching to the fixed control frequency may be measured, and it may be determined whether this elapsed time exceeds the waiting time, as calculated in advance, for the output of the excitation coil to stabilize. If so, processing then continues to the next step S12. This waiting time is, for example, approximately one second and is stored in advance in the ROM 603.

As described above, in the present embodiment, in which a magnetic shunt alloy is used to prevent an excessive rise in temperature in the non-sheet passing regions of the fixing belt 155, feedback control is performed until the Curie temperature is about to be reached, at which point fixed frequency control is performed to switch to a fixed control frequency that takes into account the drop in power of the excitation coil 173 upon reaching the Curie temperature. This structure therefore suppresses the occurrence of temperature variation in the circumferential direction of the fixing belt 155, thereby preventing the occurrence of uneven fixing and uneven gloss in so far as possible.

Note that in the present embodiment, the controller 60 and the frequency controller 191 function as the "power controller" and the "determiner" in the above aspect of the present invention when performing the steps in the flowcharts of FIGS. 10 and 11.

Modifications

The present invention is not limited to the above embodiment, and the following modifications may be adopted.

(1) Modification to Processing for Determining Whether the Curie Temperature is About to be Reached During temperature regulation in the above embodiment, it is determined that the Curie temperature is about to be reached in the non-sheet passing regions of the fixing belt 155 when the non-sheet passing region temperature Ts detected by the end thermistor 181 reaches a predetermined threshold temperature of 220° C. (see the processing to determine whether the Curie temperature is about to be reached in FIG. 11).

In the above embodiment, the end thermistor 181 is a required component. The following modification, however, describes processing for determining whether the Curie temperature is about to be reached without use of the end thermistor 181.

1.1 Modification 1

In the present modification, it is determined whether the temperature of the non-sheet passing regions of the fixing belt 155 is about to reach the Curie temperature based on changes in the control frequency output to the switching element 192 by the CPU 1911 in the IH power supply 190.

Figures 12, 13:
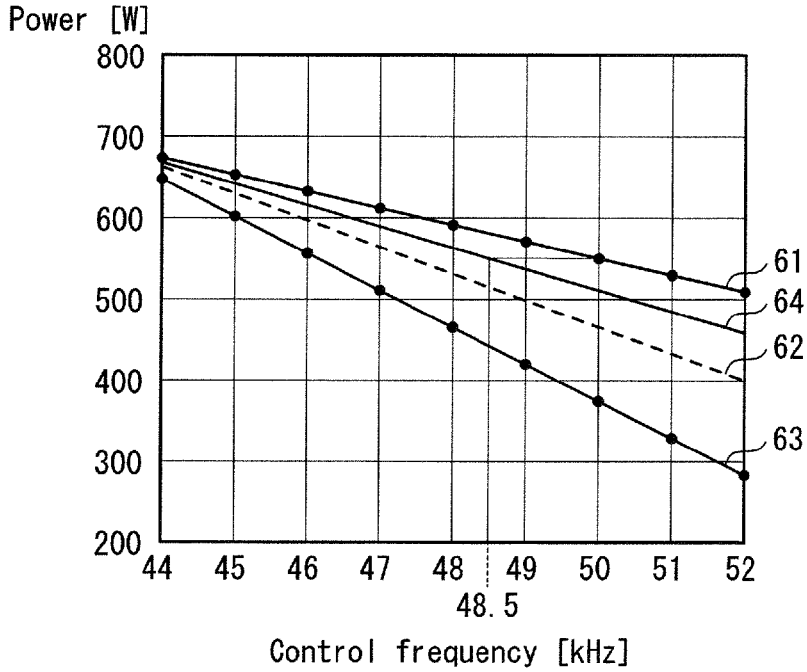
FIG. 12 is a graph showing the relationship between control frequency and power before and after the Curie temperature is reached, in order to illustrate threshold control frequency in Modification 1 of the processing to determine whether the Curie temperature is about to be reached.
FIG. 13 shows an example of a threshold control frequency table in Modification 1.

FIG. 12 is a graph showing the relationship between the power supplied to the excitation coil 173 and the control frequency. The horizontal axis represents the control frequency (kHz), and the vertical axis represents the power supplied to the excitation coil 173 (W).

The line 61 indicates the relationship between control frequency and power while the entire fixing belt 155 is being maintained at the target fixing temperature. The line 62 indicates the relationship between control frequency and power when the non-sheet passing region temperature Tp reaches the Curie temperature during continual passing of A4T size sheets through the nip. The line 63 indicates the relationship between control frequency and power when the entire fixing belt 155 has reached the Curie temperature.

As shown in FIG. 12, as the extent of the fixing belt 155 that has reached the Curie temperature increases, the power actually supplied to the excitation coil 173 decreases for the same control frequency.

It is therefore possible to draw a line 64, for example, passing through points that are each calculated by proportional distribution at a predetermined ratio between a point on line 61 and a point on line 62 for the same control frequency, and then to determine that the Curie temperature is about to be reached when the power drops to the level of line 64 (hereinafter, line 64 is referred to as a "threshold line", and the value of each control frequency along the threshold line 64 is referred to as a "threshold power").

This threshold line 64 can be sought in advance by experiment. For example, the power being supplied may be detected for a plurality of control frequencies when, as in the above embodiment, the non-sheet passing region temperature Tp of the fixing belt 155 reaches a temperature that is a predetermined amount lower than the Curie temperature (220° C. in the above embodiment). Each of these detected power values may then be plotted, and a linear approximation may be sought.

Based on the threshold line 64 determined in this way, the threshold power for each target power can be determined.

Since the CPU 1911 performs feedback control in order to maintain the power supplied to the excitation coil 173 at the target power, the value of the power being supplied will not fall below the threshold power before the Curie temperature is reached.

In the present modification, therefore, the control frequency emitted by the CPU 1911 is monitored, and when becoming equal to or less than a predetermined threshold frequency, it is determined that the Curie temperature is about to be reached.

Specifically, for example, if the target power notified by the controller 60 is 550 W, the CPU 1911 first controls the switching element 192 at a control frequency of 50 kHz, as described above. When reactive power increases and the power supplied to the coil gradually drops, the CPU 1911 lowers the control frequency through feedback control in order to maintain the power at 550 W. If the power should happen to fall to the threshold power due to feedback control not functioning, then in order to maintain the power at the threshold power of 550 W, the CPU 1911 performs control at a control frequency of 48.5 kHz, which corresponds to a power of 550 W along the threshold line 64 in FIG. 12.

Therefore, if the target power is set to 550 W, then when the current control frequency from the CPU 1911 reaches 48.5 kHz, it can be determined that the Curie temperature is about to be reached.

The threshold control frequency corresponding to each target power is thus calculated in advance based on the graph in FIG. 12 in order to create a threshold control frequency table that is stored in the ROM 603.

FIG. 13 shows an example of the above threshold control frequency table. In the above embodiment, the range of the target power is from 515 W to 670 W, as used during temperature regulation, but of course the present invention is not limited to this range.

Figure 14:
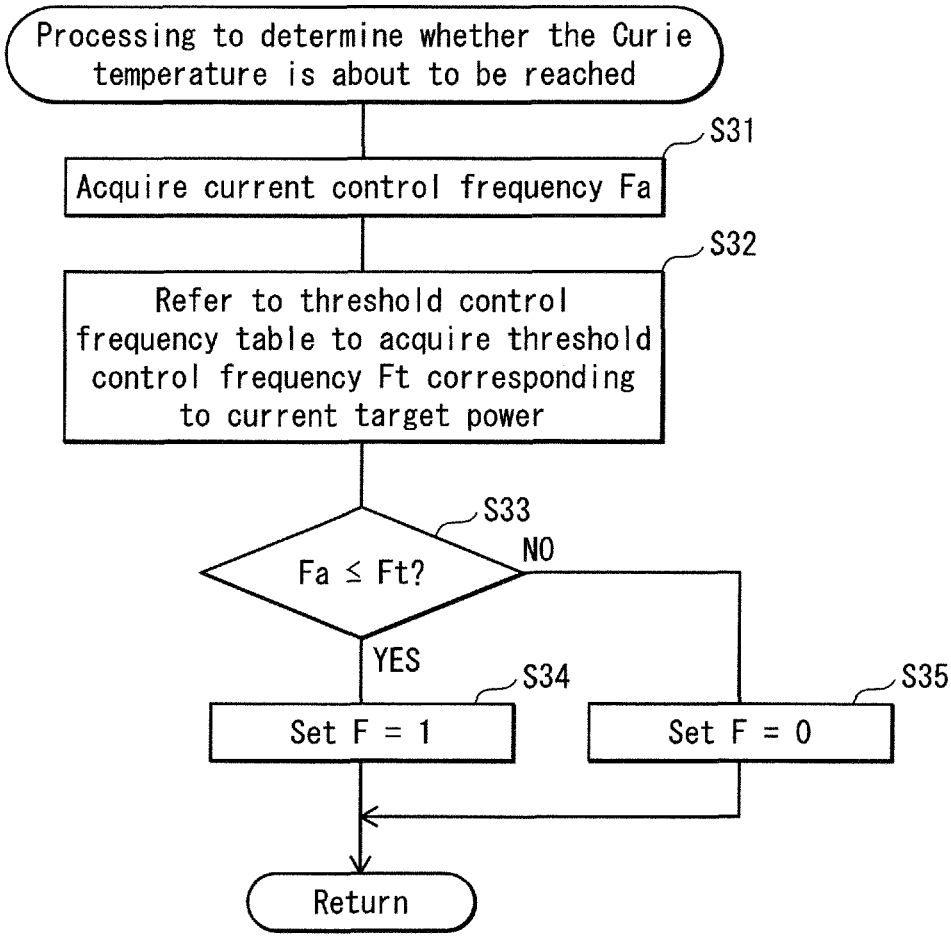
FIG. 14 is a flowchart showing control for processing to determine whether the Curie temperature is about to be reached in Modification 1.

FIG. 14 is a flowchart showing the control in the present modification for the processing to determine whether the Curie temperature is about to be reached.

First, the controller 60 acquires the control frequency Fa currently being provided to the switching element 192 by the CPU 1911 (step S31).

Next, the controller 60 refers to the threshold control frequency table shown in FIG. 13 in order to acquire the threshold control frequency Ft corresponding to the target power of which the CPU 1911 has currently been notified (step S32).

The controller 60 then determines whether the current control frequency Fa is equal to or less than the threshold control frequency Ft, i.e. whether Fa≤Ft (step S33).

If Fa≤Ft, it can be considered that the Curie temperature is about to be reached, and therefore the controller 60 sets the flag F to 1 (step S33: YES, step S34). If Fa≤Ft, the controller 60 clears the flag F to 0 to indicate that the Curie temperature is not about to be reached (step S33: NO, step S35).

Upon completion of the above steps, processing returns the flowchart in FIG. 10, and the status of the above flag is determined in step S9. If F=1 (step S9: YES), control switches to being based on a fixed control frequency (step S10).

1.2 Modification 2

When the non-sheet passing region temperature Tp of the fixing belt 155 nears the Curie temperature, the reactor value of the excitation coil 173 changes, thus causing the resonance waveform produced in the LC resonance circuit of the IH power supply 190 to change. It is possible to determine whether the Curie temperature is about to be reached using a parameter that indicates the status of this change.

FIGS. 15A through 15C and FIG. 16 illustrate the resonance waveform occurring in the LC resonance circuit composed of the capacitor 193 in the IH power supply 190 and the excitation coil 173 (in the present modification, the resonance waveform is the voltage change at the collector (point Q) of the switching element 192).

Figure 15A:
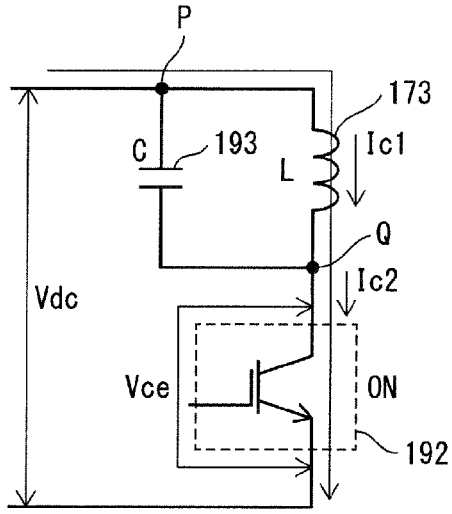
FIGS. 15A, 15B, and 15C illustrate operations of an LC resonance circuit in the IH power supply.

A voltage Vdc output by the diode bridge 195 is applied between the point P and the emitter of the switching element 192 (see FIG. 5). Under this condition, when the switching element 192 turns on due to a control frequency from the CPU 1911, then as shown in FIG. 15A, a current Ic1 and a current Ic2 flow between the excitation coil 173 and the collector and emitter of the switching element 192 respectively (see part (a) of FIG. 16).

Figure 15B:
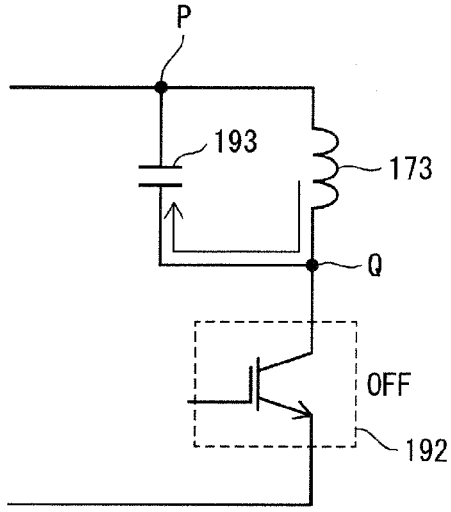
Figure 15C:
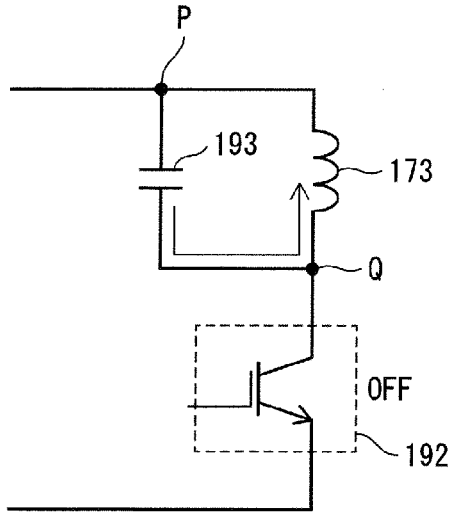

Subsequently, when the switching element 192 is turned off, current within the excitation coil 173 flows into the capacitor 193, as shown in FIG. 15B, causing the potential at point Q to gradually rise (see part (b) of FIG. 16).

Figure 16:
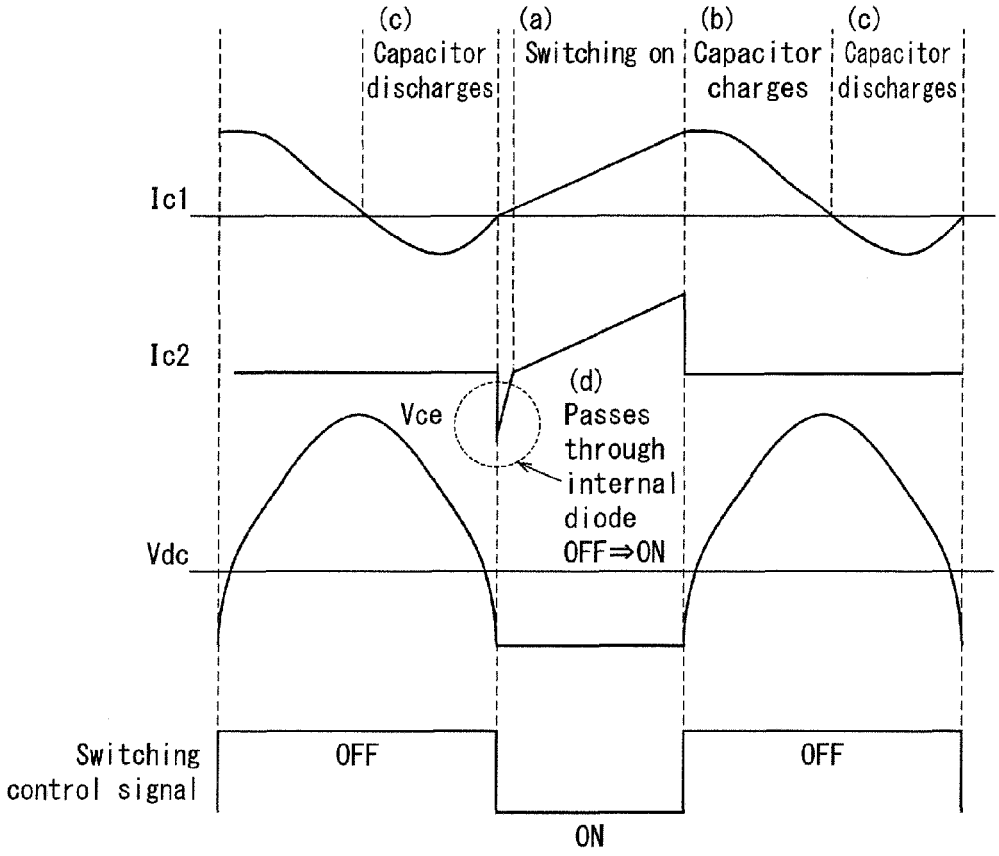
FIG. 16 illustrates the relationship between a switching signal for switching ON/OFF via the control frequency and changes in resonance waveform.

When the capacitor 193 completely charges, the charge stored in the capacitor 193 discharges, so the current flows in the opposite direction in the excitation coil 173, causing the potential at point Q to drop (see part (c) of FIG. 16).

At that point in time when the control frequency switches from off to on, the electrical energy that was stored in the excitation coil 173 passes through a diode D (not shown in the figures) internal to the switching element 192, causing regenerated current to flow (see part (d) of FIG. 16).

Subsequently, parts (a) and (b) of FIG. 16 are repeated as the switching control signal turns on and off in response to the control frequency.

The resonance waveform (the change in the voltage Vice) in the IH power supply 190 thus changes to a mountain-like shape when the switching signal turns off. When the switching control signal is on, the voltage becomes a predetermined value (referred to here as V0).

As the non-sheet passing region temperature Tp of the fixing belt 155 nears the Curie temperature and the magnetic property changes, the reactor value of the excitation coil 173 changes, causing the time interval during which the resonance waveform occurs to lengthen.

FIGS. 17A and 17B show changes in the resonance waveform respectively before and after the Curie temperature is reached.

In the example shown in these figures, the interval during which one resonance waveform (hereinafter, the "LC resonance interval") occurs before the Curie temperature is reached is 7 μs (see FIG. 17A), whereas this interval lengthens to 9 μs after the Curie temperature is reached (see FIG. 17B).

For each predetermined target power, a threshold resonance interval at a point in time when the Curie temperature is about to be reached is calculated by experiment or the like. It can then be determined that the Curie temperature is about to be reached when the LC resonance interval reaches this threshold.

In the present modification, as shown by the line with alternate long and two short dashes in FIG. 5, the IH power supply 190 has a circuit configuration such that the potential at point Q is input into the CPU 1911, thus allowing the CPU 1911 to detect the LC resonance interval. The LC resonance interval may be acquired by, for example, a comparator within the CPU 1911 comparing the potential at point Q with a reference voltage "Vo" and measuring the time during which the potential at point Q is higher than the reference voltage.

This measurement of time can easily be made by counting cycles of the internal clock. The LC resonance interval thus acquired is continually transmitted to the controller 60. A threshold resonance interval table such as the one shown in FIG. 18 is created in advance and stored in the ROM 603.

Figure 19:
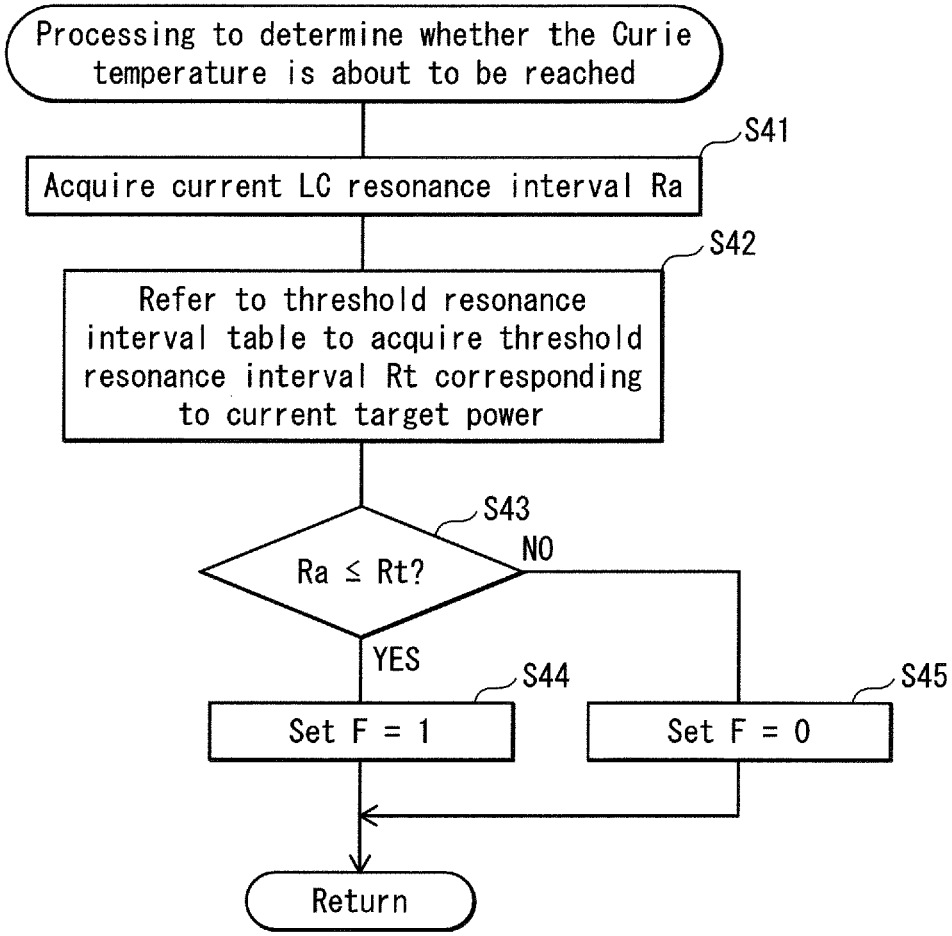
FIG. 19 is a flowchart showing control for processing to determine whether the Curie temperature is about to be reached in Modification 2.

FIG. 19 is a flowchart showing the control in the present modification for the processing to determine whether the Curie temperature is about to be reached.

First, the controller 60 updates the LC resonance interval as transmitted by the CPU 1911, storing the new value in the RAM 604 and treating the latest updated LC resonance interval as the current LC resonance interval Ra (step S41).

Next, the controller 60 refers to the threshold resonance interval table shown in FIG. 18 in order to acquire the threshold resonance interval Rt corresponding to the target power of which the CPU 1911 has currently been notified (step S42).

The controller 60 then determines whether the current LC resonance interval Ra is equal to or greater than the threshold resonance interval Rt, i.e. whether Ra≥Rt (step S43).

if Ra≥Rt, it can be considered that the Curie temperature is about to be reached, and therefore the controller 60 sets the flag F to 1 (step S43: YES, step S44). If Ra<Rt, the controller 60 clears the flag F to 0 to indicate that the Curie temperature is not about to be reached (step S43: NO, step S45).

Upon completion of the above steps, processing returns the flowchart in FIG. 10, and the status of the above flag is determined in step S9. If F=1 (step S9: YES), control switches to control based on a fixed control frequency (step S10).

Note that as shown in FIGS. 17A and 17B, the LC resonance interval is equivalent to the interval in which the switching control signal is off (hereinafter referred to as the "off interval"). Therefore, it can be determined whether the Curie temperature is about to be reached by monitoring the off interval instead. The off interval can easily be measured by the CPU 1911 detecting the off state of the control frequency that the same CPU 1911 generates and then counting clock cycles.

The controller 60 may acquire the off interval from the CPU 1911 and determine that the Curie temperature is about to be reached when the off interval is equal to or greater than a threshold off interval acquired from a threshold off interval table (not shown in the figures) created in the same way as FIG. 18. The flowchart in this case is nearly identical to FIG. 19, with the exception that the LC resonance interval is replaced with the off interval. Therefore, this flowchart is not shown in the figures.

Note that the threshold tables in Modifications 1 and 2 above have been described assuming a particular size (A4T) of regular paper for the recording sheets. The threshold tables can be adapted, however, for a different thickness of recording sheet when determining whether the Curie temperature is about to be reached using, as an index, the change in a parameter (in Modification 1, the control frequency, and in Modification 2, the LC resonance interval or the off interval) when performing feedback control on the power supplied to the excitation coil 173.

Since the amount of change in the reactor value of the excitation coil 173 varies when the Curie temperature is reached depending on the size of the non-sheet passing regions (see FIG. 12), a separate threshold table may be created for each size of recording sheet. The controller 60 may then refer to the corresponding table, based on the print conditions for the print job currently being executed, when performing the above temperature regulation. This approach allows for more precise temperature regulation.

1.3 Modification 3

In the present modification, it is determined whether the Curie temperature is about to be reached based on the number of recording sheets that have been continually passed through the nip.

The temperature in the non-sheet passing regions excessively rises due to power being supplied to the excitation coil 173 in order to maintain the sheet passing region temperature Ts at a constant fixing temperature, despite the fact that the non-sheet passing regions are not deprived of heat by the recording sheets that are being continually passed through the nip. Therefore, counting the number of continually printed sheets can serve as a basis for determining whether the non-sheet passing region temperature Tp is about to reach the Curie temperature. In this case, the range and the temperature rise characteristics of the non-sheet passing regions vary depending on the thickness and size of the recording sheets being passed.

Therefore, in the present modification, the number of sheets that have been continually passed through the nip when the non-sheet passing region temperature Tp is about to reach the Curie temperature is calculated for recording sheets of various sizes and thicknesses. This number of sheets is then used as a threshold (threshold sheet number) for determining whether the Curie temperature is about to be reached.

FIG. 20 is an example of a basic threshold sheet number table that lists the basic threshold sheet number for each size of recording sheet that is passed. In this table, A4T for example refers to an A4 size recording sheet being passed lengthwise. Regular paper refers to regularly used copy paper, having a basis weight in a range from 62 g/m$^2$ to 71 g/m$^2$. Thick paper has a basis weight in a range from 210 g/m$^2$ to 244 g/m$^2$.

In this table, the reason why the threshold sheet number is lower for thick paper than for regular paper is that thick paper absorbs more heat during fixing, making a corresponding increase in the output of the excitation coil necessary. As a result, the rate of temperature increase in the non-sheet passing regions rises.

Furthermore, as the size of the recording sheet is smaller, the width of the non-sheet passing regions increases, thus increasing the ratio of accumulated heat to heat that is dissipated from either end Of the fixing belt 155. In this case as well, the temperature of the non-sheet passing regions rises more easily, resulting in a decrease in the threshold sheet number.

Note that the above basic threshold sheet numbers were determined by experiment when continuous printing began after the completion of warm-up under the following basic conditions: the sheet passing region temperature Ts of the fixing belt 155 at the start of warm-up was in a range of 16° C. to 30° C., and the environment within the apparatus was at a temperature in a range of 19° C. to 29° C. and a humidity (relative humidity) between 16% and 79% (hereinafter, these temperature and humidity ranges are referred to as an "NN" environment).

Figure 24:
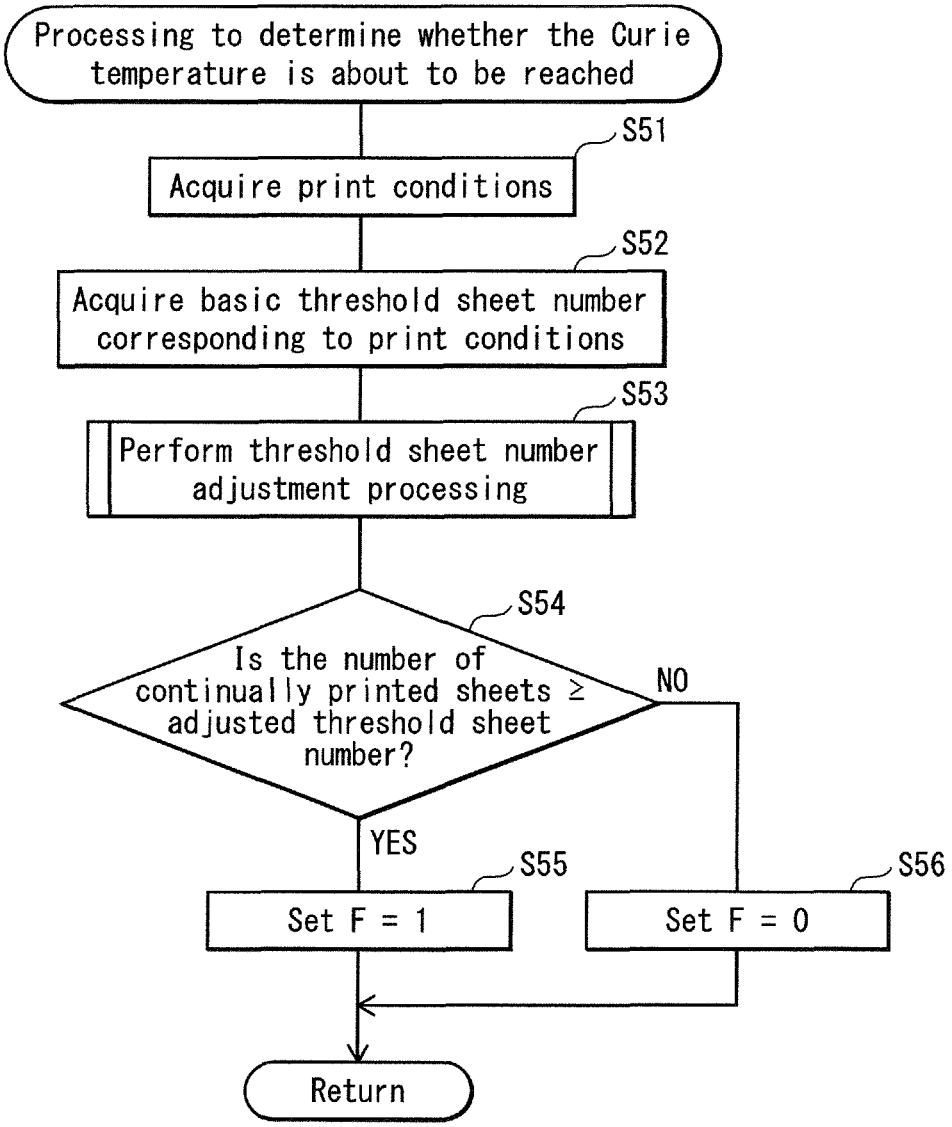
FIG. 24 is a flowchart showing control for processing to determine whether the Curie temperature is about to be reached in Modification 3.

In the present modification, it is determined whether the Curie temperature is about to be reached by appropriately adjusting the threshold sheet number, using the threshold sheet number listed in the basic threshold sheet number table as a reference. The threshold sheet number is adjusted based on the internal environment of the apparatus, the temperature at the start of warm-up, and the standby time, with reference to adjustment tables H1 through H3 (FIGS. 21 through 23). The following describes the present modification in detail based on the flowchart in FIG. 24 illustrating the processing to determine whether the Curie temperature is about to be reached.

First, the controller 60 refers to the print condition storage unit 606 (FIG. 4) to acquire the print conditions for a received print job (step S51).

As described above, these print conditions include information on the number of pages to be printed, the size of the recording sheet, and the type of recording sheet (regular or thick paper). The print conditions are input by the user when issuing a print job with the print driver of an external terminal and are attached to the data for the print job.

In step S52, the controller 60 reads the print conditions from the print condition storage unit 606 (in this case, only the information on the size and type of the recording sheet are read from among the print conditions) and acquires the basic threshold sheet number corresponding to the print conditions from the basic threshold sheet number in FIG. 20.

The controller 60 then performs threshold sheet number adjustment processing to adjust the basic threshold sheet number in accordance with the following conditions (step S53).

Figure 25:
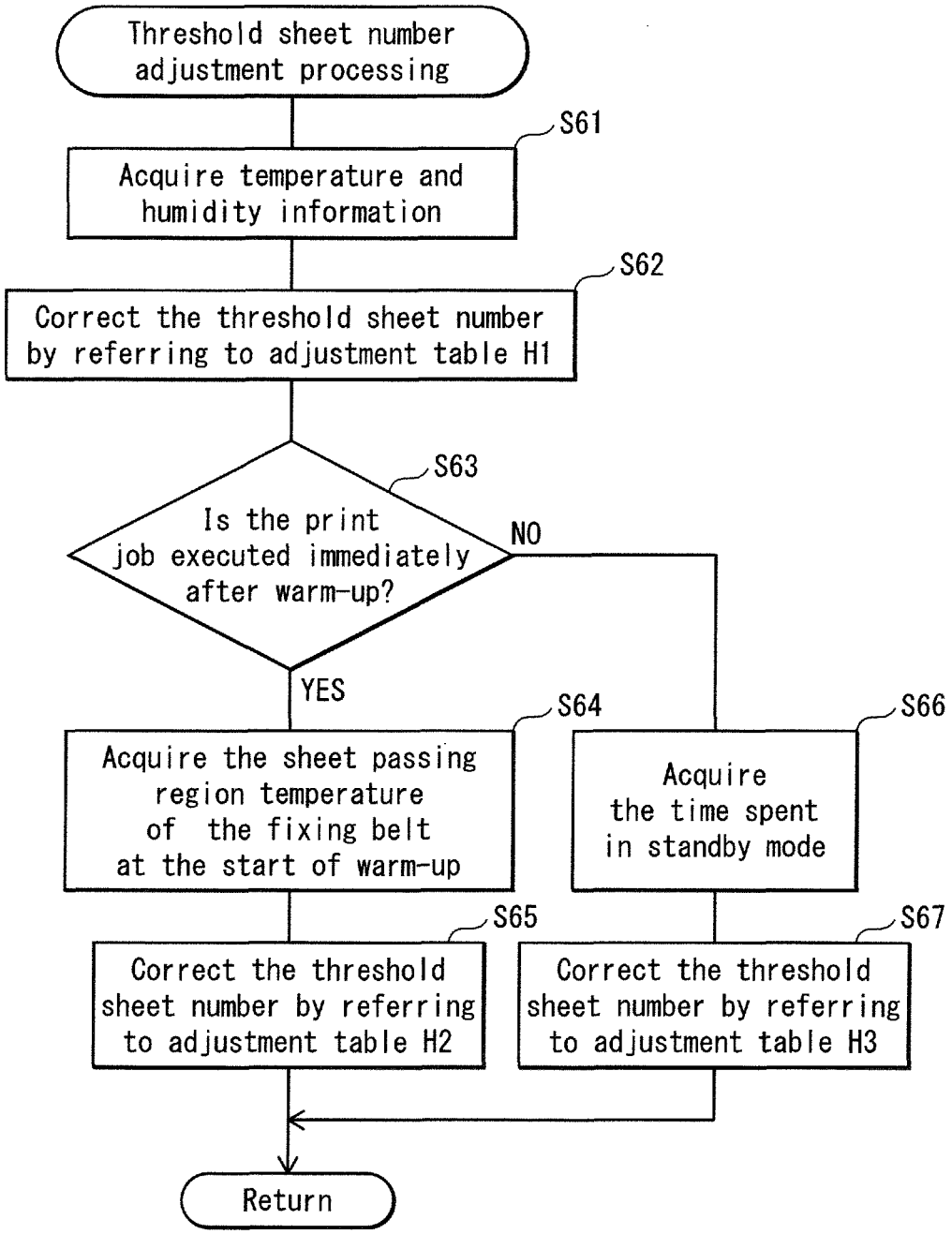
FIG. 25 is a flowchart showing control for threshold sheet number adjustment processing in step S53 of FIG. 24.

FIG. 25 is a flowchart showing the content of a subroutine for threshold sheet number adjustment processing.

First, the controller 60 refers to the value detected by the temperature and humidity sensor 182 to acquire information on the temperature and humidity within the apparatus, which is information on the surrounding temperature and humidity from the perspective of the fixing device 5 (step S61).

Based on this temperature and humidity information and on the adjustment table H1 in FIG. 21, the controller 60 adjusts the basic threshold sheet number.

In the adjustment table H1 in FIG. 21, the environment within the apparatus is divided into three categories for the above temperature and humidity information, based on the climate in Japan: in addition to the NN environment described above, the adjustment table H1 lists an LL environment having a low temperature (10° C. or less) and a low humidity (15% or less), and an HH environment having a high temperature (30° C. or greater) and a high humidity (80% or greater).

If the humidity and temperature information indicates an NN environment, the environment is the same as for the basic threshold sheet number. The adjustment sheet number is therefore zero.

If the environment is an LL environment, however, the difference with the surrounding temperature is high, making it easy for heat to escape. This increases the amount of dissipated heat in the non-sheet passing regions. The rate of increase of the non-sheet passing region temperature Tp is therefore lower than in an NN environment, and so the threshold sheet number is adjusted to be larger.

Conversely, it is harder for heat to escape in an HH environment, and therefore the rate of increase of the non-sheet passing region temperature Tp is higher than in an NN environment. The threshold sheet number is thus adjusted to be smaller.

In the present example, the adjustment table H1 has been created based on two types of environment information, temperature and humidity. Of these, temperature is more relevant for determining whether the Curie temperature is about the reached. Furthermore, the climate in Japan exhibits some degree of correlation between temperature and humidity. Therefore, the humidity information may be omitted, and a table showing the relationship between temperature and the adjustment sheet number may be created. It is then possible to acquire only the temperature in step S61 and refer to this table.

Next, the controller 60 determines whether the current print job occurs immediately after warm-up (step S63).

If so (step S63: YES), the controller 60 acquires the sheet passing region temperature Ts at the start of warm-up (step S64).

In the present modification, the output of the central thermistor 180 at the start of warm-up is acquired and stored in the RAM 604. In step S64, the controller 60 refers to the value stored in the RAM 604 to acquire the sheet passing region temperature Ts at the start of warm-up.

The controller 60 then refers to the adjustment table H2 in FIG. 22 to adjust the threshold sheet number (step S65).

As shown in FIG. 22, this adjustment table H2 lists threshold sheet numbers for each size and type of recording sheet for different ranges of the temperature at the start of warm-up.

First of all, when the temperature at the start of warm-up is in a range of 16° C. to 30° C., the temperature is the same as the basic conditions. Adjustment is therefore not necessary, and the adjustment number of sheets is zero.

If the temperature at the start of warm-up is lower than this range, it can be assumed that a long time has elapsed since the previous print operation, and that both the non-sheet passing region temperature Tp and the sheet passing region temperature Ts are low, with no difference in temperature therebetween. In this case, the non-sheet passing region temperature Tp after the start of printing can be expected to take a long time tc rise to the Curie temperature. Therefore, the threshold sheet number is adjusted in this case for each size and type of paper.

On the other hand, if the temperature at the start of warm-up is 31° C. or greater, it can be assumed that the amount of time elapsed since the end of the last print job is shorter as the temperature increases. In this case, the difference in temperature between the non-sheet passing region temperature Tp and the sheet passing region temperature Ts has not yet been eliminated, and it can be assumed that performing the print job after warm-up operations for the sheet passing region temperature to reach the fixing temperature will cause the non-sheet passing region temperature Tp to quickly reach the Curie temperature. Therefore, as the temperature at the start of warm-up rises above 31° C., the threshold sheet number in the table is adjusted to be lower.

In step S63, when determining that a print job is not being performed immediately after warm-up, the controller 60 determines that the printer 1 had been in standby mode and acquires the time spent in standby mode (hereinafter referred to as the "standby interval").

As described above, standby mode is a control mode in which, after completion of a print job, the fixing belt 155 is maintained at a temperature (such as 150° C.) that is slightly lower than the target fixing temperature in order to allow for execution of the next print job shortly after reception thereof.

In the present modification, a counter internal to the CPU 61 counts the clock beginning at the start of standby mode and stores the count in the RAM 604. In step S66, the controller 60 refers to the value stored in the RAM 604 to acquire the standby interval.

The controller 60 then refers to the adjustment table H3 in FIG. 23 to adjust the threshold sheet number based on the acquired standby interval (step S67).

As the standby time is shorter, a larger difference in temperature remains between the sheet passing region and the non-sheet passing region due to execution of the previous print job, and it can be assumed that the non-sheet passing region temperature Tp will reach the Curie temperature in a correspondingly shorter amount of time. As shown in FIG. 23, the adjustment table H3 is therefore created to reduce the basic threshold sheet number to a large degree.

After adjusting the basic threshold sheet number in this way, processing returns to the flowchart in FIG. 24, and in step S54, the controller 60 determines whether the number of continually printed sheets for the print job currently being executed has reached the adjusted threshold sheet number.

In this context, the number of continually printed sheets is, for example, acquired by a jam detection sensor (not shown in the figures), located at the exit of the fixing device 5, detecting the end of a recording sheet that passes by, with the controller 60 counting the number of detection signals received since the start of printing.

Once the number of continually printed sheets reaches at least the adjusted threshold sheet number (step S54: YES), the controller 60 determines that the Curie temperature is about to be reached and sets the flag F1 to 1 (step S55).

Conversely, if the number of continually printed sheets is less than the adjusted threshold sheet number (step S54: NO), the controller 60 determines that the Curie temperature is not about to be reached and clears the flag F1 to 0 (step S55).

Upon completion of the above steps, processing returns the flowchart in FIG. 10, and the status of the above flag is determined in step S9. If F=1 (step S9: YES), control switches to control based on a fixed control frequency (step S10).

Note that in the present modification, if the number of continually printed sheets is incremented when the end of a recording sheet passes through the nip, then at the point at which the number of continually printed sheets becomes the adjusted threshold sheet number (step S54: YES), no recording sheet is located in the nip. Therefore, by immediately performing step S10 (FIG. 10), it is possible to switch from feedback control to fixed frequency control by the time the tip of the next recording sheet reaches the nip.

As was also shown in FIG. 9, a predetermined transition time is necessary to transition from the control frequency during feedback control to the fixed control frequency, and it is difficult to perfectly match and offset the change in output due to the change in the reactor value of the excitation coil. As indicated by the portion labeled J, a fluctuation in power thus occurs, however slight. As a result, a location that is slightly higher than the target fixing temperature occurs, as indicated by the portion labeled G in the temperature change curve in FIG. 8. This amount of temperature change is a smaller variation, however, than the amount of temperature change when reaching the Curie temperature during conventional temperature regulation (as indicated by the portion labeled E in FIG. 8). Moreover, this variation causes the temperature to rise, thereby not leading to defective fixing. Furthermore, even if uneven gloss occurs due to this difference in temperature, such uneven gloss is considered to be within an allowable range.

When image quality needs to be increased, however, such as when reproducing precision color images, it is preferable for temperature variation not to occur during the fixing of one recording sheet, in so far as possible.

By switching to the fixed control frequency between recording sheets as above, even if such a temperature variation occurs, it will have no effect whatsoever on the fixing of the toner image to the recording sheet.

The present modification determines whether the Curie temperature is about to be reached based on the number of continually printed sheets. In addition to the number of continually printed sheets, a threshold for the continual printing time for each size may be set, since the time for printing one page of each size of recording sheet is known, and it may be determined whether the Curie temperature is about to be reached based on this threshold.

In the present invention, an index that indicates the number of continual image formation sheets may be defined as a concept that encompasses both the number of continually printed sheets and the continual printing time.

Furthermore, while the threshold sheet number is determined above in accordance with the size and type (regular or thick paper) of recording sheet, some models may not allow for use of thick paper, or may only allow for use of recording sheets of a certain size. Therefore, it is not absolutely necessary to set the threshold sheet number for all possible categories.

If the above control is considered to be control of only the fixing device 5, the print job and the number of printed sheets can respectively be considered a fixing job and a number of sheets passing through the nip.

(2) Other Modifications (2.1) In Modification 3, it has been described how a fixed frequency can be switched to when no recording sheet is located in the nip of the fixing device 5.

In the embodiment and the other modifications, however, the location of the recording sheet is uncertain at the time it is determined that the Curie temperature is about to be reached.

The present modification, therefore, allows for the embodiment and the modifications other than Modification 3 to switch to the fixed frequency control between recording sheets, when no recording sheet is located in the nip of the fixing device 5, i.e. between when the end of a recording sheet exits the nip and the tip of the next recording sheet reaches the nip while recording sheets are being continually passed through the nip.

Figure 26:
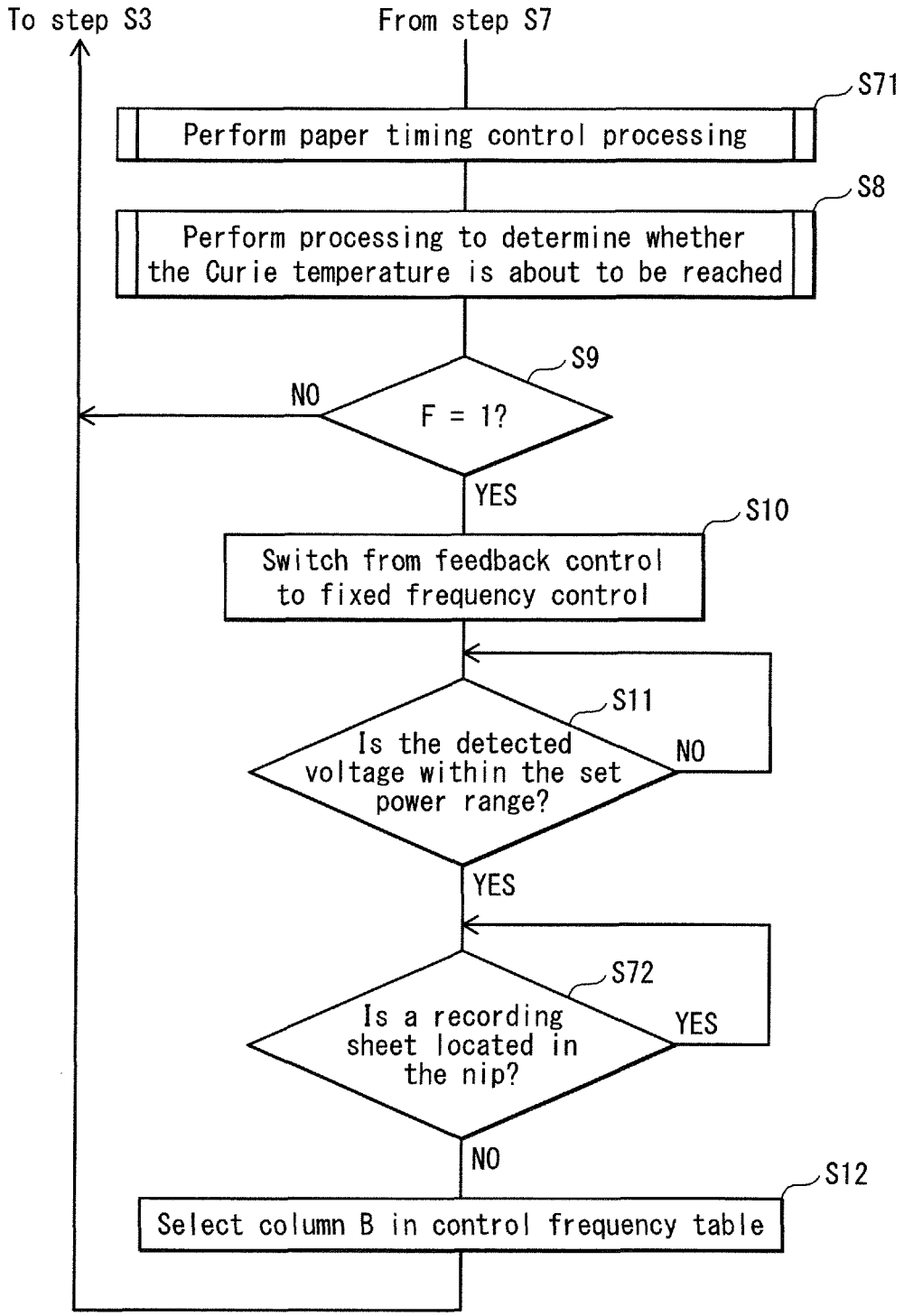
FIG. 26 is a partial flowchart showing control in a modification to temperature regulation in FIG. 10.

FIG. 26 is part of a flowchart showing control for temperature regulation in the present modification, mainly showing the portions that differ from the flowchart in FIG. 10.

The present modification is characteristic in that before the processing to determine whether the Curie temperature is about to be reached in step S8, paper timing control processing (step S71) is performed.

Figure 27:
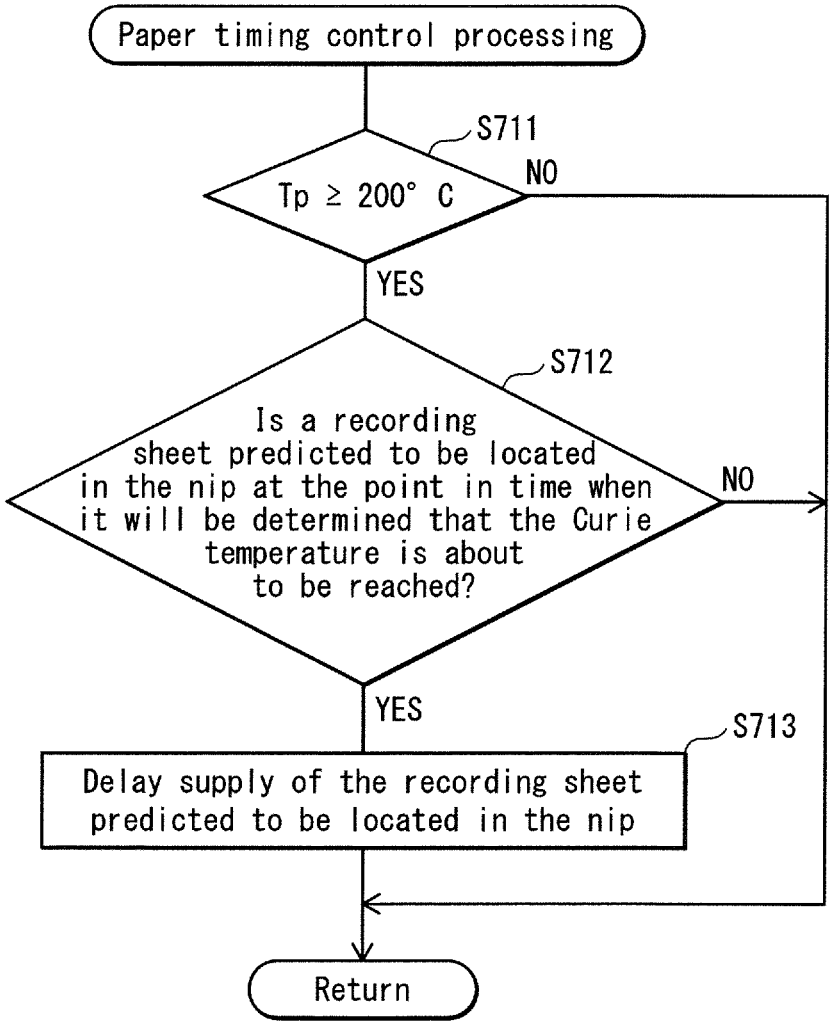
FIG. 27 is a flowchart showing the content of paper timing control processing in step S71 of FIG. 26.

FIG. 27 is a flowchart showing the content of a subroutine for the paper timing control processing. For the sake of convenience, the determination of whether the Curie temperature is about to be reached is assumed to be made based on the non-sheet passing region temperature Tp (see FIG. 11).

First, the output of the end thermistor 181 is referred to in order to determine whether the non-sheet passing region temperature Tp is at least a predetermined temperature, set to 200° C. in the present modification (step S711).

This predetermined temperature is lower than the threshold temperature (220° C.) for determining whether the Curie temperature is about to be reached and is set to be equal to the non-sheet passing region temperature Tp at a point in time that is a predetermined time tc earlier than when the threshold temperature is reached.

The predetermined time tc is preferably larger than the time required from the start of the next image formation operations by the image process unit 3 (in the present modification, the start of scanning and exposure of the photoconductor drum 31Y in the image creating unit 3Y (FIG. 1) located furthest upstream) until the recording sheet onto which the corresponding image is transferred exits the nip of the fixing device 5.

As shown in FIG. 8, since the characteristics of change in the non-sheet passing region temperature Tp are calculated in advance, it is possible to determine the non-sheet passing region temperature Tp at a point in time that is a predetermined time tc earlier than when the threshold temperature is reached. This temperature is stored in the ROM 603.

If it is determined that the non-sheet passing region temperature Tp is equal to the predetermined temperature (200° C.) in step S711 (step S711: YES), then it is determined whether a recording sheet is predicted to be located in the nip at the point in time when it will be determined that the Curie temperature is about to be reached (step S712).

Since recording sheets are supplied at regular intervals timed by the timing rollers 44, the position of the tip of the recording sheet that will be supplied after the predetermined time tc has elapsed can be calculated based on the time at which the previous recording sheet was supplied by the timing rollers 44. Based on the position of the tip of the recording sheet and on the length of the recording sheet in the direction of conveyance (acquired from the print conditions), it can be determined whether the recording sheet will be located in the nip of the fixing device 5 at the point in time when the non-sheet passing region temperature Tp is about to reach the Curie temperature.

If it is predicted that a recording sheet will be located in the nip at the point when it will be determined that the Curie temperature is about to be reached (step S712: YES), then control is performed to delay the timing at which the recording sheet is supplied (step S713).

In other words, since the position of the tip of the recording sheet supplied when the Curie temperature is about to be reached is known, as described above, control is performed in order to delay the supply of the recording sheet by at least long enough so that the tip of the recording sheet will not enter the nip of the fixing device 5 when control switches to fixed frequency control. This control delays the timing of writing by exposing the photoconductor drums in the image process unit 3, as well as the timing at which the timing rollers 44 are driven. Processing then returns to the flowchart in FIG. 26, and the processing in step S8 to determine whether the Curie temperature is about to be reached is performed.

In step S9, the value of the flag that was set during the processing to determine whether the Curie temperature is about to be reached is determined. When F does not equal one (step S9: NO), the Curie temperature is not about to be reached, and therefore processing returns to step S3, and feedback control is repeated.

In step S9, if F equals one (step S9: YES), it is determined that the Curie temperature is about to be reached, and the controller 60 instructs the CPU 1911 to switch the control frequency to a predetermined fixed control frequency. The CPU 1911 suspends feedback control in accordance with this instruction and controls the switching element 192 at the fixed control frequency (step S10).

At this point, no recording sheet is located in the nip of the fixing device 5 as a result of the above control to delay the timing at which the recording sheet is supplied. Therefore, even as a slight power variation occurs when converting from feedback control to fixed frequency control, there is no risk of uneven gloss occurring in the image reproduced on the recording sheet.

Subsequently, it is determined whether the power to the excitation coil 173 is within the set power range (step S11). If so (step S11: YES), it is then determined whether a recording sheet is located in the nip of the fixing device 5 (step S72).

This determination can be made in the same way as the determination in step S72. Furthermore, a paper passing sensor may be placed at an appropriate position upstream of the nip in the fixing device 5 in the sheet conveyance direction (or the existing jam sensor may be used). A time interval ta and a time interval tb may then be calculated and stored in the ROM 603. The time interval ta represents the time for a recording sheet to exit the nip after the end of the recording sheet is detected by the paper passing sensor. The time interval tb is yielded by dividing the distance between recording sheets, determined by design, by the recording sheet conveyance rate. A point in time is then calculated by adding the time interval ta to a time T1 when the end of the last recording sheet was detected. If the current time is within the time interval tb after this point in time, it is determined that no recording sheet is located in the nip.

When it is determined that no recording sheet is located in the net (step S72: YES), the feedback control from step S12 onward is performed.

If, in step S72, it is determined that a recording sheet is located in the nip (step S72: NO), the return to feedback control is prohibited until the recording sheet has passed through the nip, after which processing returns to the feedback control from step S12 onward.

In the present modification, image formation operations are delayed and the timing at which a recording sheet is supplied is controlled so that no recording sheet will be located in the nip when switching to fixed frequency control. Therefore, even if the power supplied to the excitation coil 173 varies slightly when control is switched, such variation will have absolutely no effect on fixing of the toner image.

The return to feedback control after fixed frequency control is also performed when no recording sheet is located in the nip. Therefore, when switching control in this case as well, a slight variation in the power supplied to the excitation coil 173 will have absolutely no effect on fixing of the toner image.

(2.2) The values in the tables of the above embodiment and modifications are no more than examples and should be adjusted appropriately in accordance with factors such as the specifications of the device being used.

Instead of a table showing relationships, expressions representing these relationships may be stored, and based on the expressions, the parameters for each type of control, such as the control frequencies and the various thresholds, may be acquired.

(2.3) In the above embodiment, the parameter for controlling the power supplied from the IH power supply 190 to the excitation coil 173 is the control frequency, but the parameter is not limited in this way. This is because other circuit structures may control power via different parameters.

(2.4) In the fixing device 5, the pressing member that presses against the fixing belt 155 to form the nip is not limited to a pressing roller. An elongated pad may be used instead.

The unit for detecting the temperature of the fixing member is of course not limited to a thermistor. For example, an infrared sensor or the like may be used.

Furthermore, while a tandem-type color printer has been described as an example of an image forming apparatus in which the fixing device 5 is used, the fixing device 5 may be used in any image forming apparatus provided with an electromagnetic induction heating type fixing device and having a structure that uses a magnetic shunt alloy to prevent an excessive rise in temperature in the non-sheet passing regions, as described above. For example, the fixing device 5 may be used in a monochrome printer, a copier, a facsimile machine, a multifunction printer, or the like.

The above embodiment and modifications may be combined insofar as possible.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device comprising:

an excitation coil supplied with power and generating an alternating magnetic field;

a fixing member heated by electromagnetic induction resulting from the alternating magnetic field;

a pressing member forming a nip by pressing against the surface of the fixing member, an unfixed image on a recording sheet being thermally fixed to the recording sheet upon the recording sheet passing through the nip;

a magnetic shunt alloy member having a Curie temperature set to be a predetermined temperature higher than a target fixing temperature and arranged so as to suppress, when heated to the Curie temperature and above, a rise in temperature in a non-sheet passing region of the fixing member, the non-sheet passing region being a region through which the recording sheet does not pass;

a sheet passing region temperature detector configured to detect a temperature of a sheet passing region of the fixing member, the sheet passing region being a region through which the recording sheet passes;

a determiner configured to determine whether a temperature of the non-sheet passing region is about to reach the Curie temperature;

a power controller configured to set a parameter for controlling the power supplied to the excitation coil; and a power supply configured to supply the power to the excitation coil in accordance with the set parameter, wherein until the determiner determines that the temperature of the non-sheet passing region is about to reach the Curie temperature, the power controller performs first control to select a target power to be provided to the excitation coil, according to the temperature detected by the sheet passing region temperature detector, and to adjust the parameter so as to maintain the power supplied to the excitation coil at the target power by feedback control, and when the determiner determines that the temperature of the non-sheet passing region is about to reach the Curie temperature, the power controller switches to performing second control to provide power to the excitation coil by switching the parameter to a predetermined fixed parameter, the fixed parameter being set so that a difference between the power supplied when the temperature of the non-sheet passing region is about to reach the Curie temperature and the power supplied after reaching the Curie temperature falls within an allowable range.

2. The fixing device of claim 1, further comprising a non-sheet passing region temperature detector configured to detect a temperature of the non-sheet passing region of the fixing member, wherein the determiner determines whether the temperature of the non-sheet passing region is about to reach the Curie temperature according to the temperature detected by the non-sheet passing region temperature detector.

3. The fixing device of claim 1, wherein the determiner determines whether the temperature of the non-sheet passing region is about to reach the Curie temperature according to changes in the parameter due to feedback control during the first control.

4. The fixing device of claim 1, wherein the power supply includes an LC resonance circuit and a switching element that switches a current supply to the LC resonance circuit on and off, the parameter is a control frequency for switching the switching element on and off, and the determiner determines whether the temperature of the non-sheet passing region is about to reach the Curie temperature according to one of an interval during which the switching element is off and changes in a resonance interval of the LC resonance circuit during the first control.

5. The fixing device of claim 1, wherein the determiner determines that the temperature of the non-sheet passing region is about to reach the Curie temperature when a number of sheets that have continually passed during a fixing job currently being executed reaches a predetermined threshold set in accordance with a type of the recording sheet.

6. The fixing device of claim 5, wherein the type of the recording sheet includes at least one of a recording sheet size and a recording sheet thickness.

7. The fixing device of claim 5, wherein among information related to surrounding temperature and humidity, the predetermined threshold is adjusted at least according to the temperature.

8. The fixing device of claim 5, wherein when the fixing job is executed after completion of warm-up, the predetermined threshold is adjusted according to the temperature of the sheet passing region of the fixing member at a start of warm-up.

9. The fixing device of claim 5, wherein when the fixing job is executed after exiting standby mode, the predetermined threshold is adjusted according to a length of time spent in the standby mode.

10. The fixing device of claim 5, wherein the power controller switches from the first control to the second control during an interval between when an end of the recording sheet corresponding to the threshold of the number of sheets that have continually passed passes through the nip in the fixing device and when a tip of the next recording sheet reaches the nip.

11. The fixing device of claim 1, wherein after switching from the first control to the second control, the power controller returns to the first control after a predetermined time elapses.

12. The fixing device of claim 1, wherein the power controller returns to the first control when a difference between the power supplied to the excitation coil after switching from the first control to the second control and the power supplied to the excitation coil before switching from the first control to the second control is within a predetermined range.

13. The fixing device of claim 11, further comprising a sheet determiner configured to determine whether a recording sheet is located in the nip; and a return prohibiting unit configured to prohibit the return by the power controller from the second control to the first control while a recording sheet is located in the nip and to permit the return once the recording sheet exits the nip.

14. The fixing device of claim 12, further comprising a sheet determiner configured to determine whether a recording sheet is located in the nip; and a return prohibiting unit configured to prohibit the return by the power controller from the second control to the first control while a recording sheet is located in the nip and to permit the return once the recording sheet exits the nip.

15. An image forming apparatus comprising a fixing device, the fixing device comprising:

an excitation coil supplied with power and generating an alternating magnetic field;

a fixing member heated by electromagnetic induction resulting from the alternating magnetic field;

a pressing member forming a nip by pressing against the surface of the fixing member, an unfixed image on a recording sheet being thermally fixed to the recording sheet upon the recording sheet passing through the nip;

a magnetic shunt alloy member having a Curie temperature set to be a predetermined temperature higher than a target fixing temperature and arranged so as to suppress, when heated to the Curie temperature and above, a rise in temperature in a non-sheet passing region of the fixing member, the non-sheet passing region being a region through which the recording sheet does not pass;

a sheet passing region temperature detector configured to detect a temperature of a sheet passing region of the fixing member, the sheet passing region being a region through which the recording sheet passes;

a determiner configured to determine whether a temperature of the non-sheet passing region is about to reach the Curie temperature;

a power controller configured to set a parameter for controlling the power supplied to the excitation coil; and a power supply configured to supply the power to the excitation coil in accordance with the set parameter, wherein until the determiner determines that the temperature of the non-sheet passing region is about to reach the Curie temperature, the power controller performs first control to select a target power to be provided to the excitation coil, according to the temperature detected by the sheet passing region temperature detector, and to adjust the parameter so as to maintain the power supplied to the excitation coil at the target power by feedback control, and when the determiner determines that the temperature of the non-sheet passing region is about to reach the Curie temperature, the power controller switches to performing second control to provide power to the excitation coil by switching the parameter to a predetermined fixed parameter, the fixed parameter being set so that a difference between the power supplied when the temperature of the non-sheet passing region is about to reach the Curie temperature and the power supplied after reaching the Curie temperature falls within an allowable range.

16. The image forming apparatus of claim 15, further comprising:

a predictor configured to predict a point in time when the temperature of the non-sheet passing region of the fixing member is about to reach the Curie temperature;

a paper feeder configured to feed the recording sheet;

an image forming unit configured to form a toner image on the recording sheet fed thereto; and an image forming controller configured to control recording sheet feeding operations by the paper feeder and toner image forming operations by the image forming unit, wherein the image forming controller controls the feeding operations and the toner image forming operations so that the recording sheet is not located in the nip of the fixing device at the predicted point in time.

* * * * *